US007591398B2

(12) United States Patent
Pritikin et al.

(10) Patent No.: US 7,591,398 B2
(45) Date of Patent: Sep. 22, 2009

(54) CONTAINER CLOSURE ASSEMBLY

(75) Inventors: Daniel Pritikin, Santa Monica, CA (US); Scott Taylor, Long Beach, CA (US); Walter Horne, Seal Beach, CA (US); Dave Palang, Long Beach, CA (US)

(73) Assignee: PouchSmart, Inc., Santa Monica, CA (US)

( * ) Notice: Subject to any disclaimer, the term of this patent is extended or adjusted under 35 U.S.C. 154(b) by 0 days.

(21) Appl. No.: 11/749,088

(22) Filed: May 15, 2007

(65) Prior Publication Data

US 2008/0073348 A1 Mar. 27, 2008

Related U.S. Application Data

(60) Provisional application No. 60/827,194, filed on Sep. 27, 2006.

(51) Int. Cl.
*B67D 5/00* (2006.01)

(52) U.S. Cl. ..... 222/80; 222/541.2; 220/267; 215/257

(58) Field of Classification Search ..... 222/490–494, 222/542.2, 80–91, 511, 513, 517, 541.2; 215/247–249, 257, 306, 252, 258; 220/203.08, 220/203.18, 255.1, 258.4, 258.5, 267, 277, 220/278, 279, 291
See application file for complete search history.

(56) References Cited

U.S. PATENT DOCUMENTS 2,671,577 A * 3/1954 Remington et al. ..... 222/92
2,771,218 A * 11/1956 Henderson ..... 222/83
2,907,489 A 10/1959 Taylor
3,067,787 A * 12/1962 Salk ..... 141/321
3,109,562 A * 11/1963 Ferris ..... 222/81
3,182,858 A 5/1965 Beaudoin
3,392,859 A 7/1968 Fischer
3,454,196 A 7/1969 Hazard
3,904,062 A * 9/1975 Grussen ..... 215/252
4,307,821 A * 12/1981 McIntosh ..... 222/83

(Continued)

FOREIGN PATENT DOCUMENTS

JP 2003-182754 * 7/2003

*Primary Examiner*—Lien T Ngo
(74) *Attorney, Agent, or Firm*—Jeffer Mangels Butler & Marmaro LLP

(57) ABSTRACT

A container closure assembly that includes a base that is adapted to be connected to a container, a spout extending upwardly from the base, and a cap removably secured on the spout. The spout defines an interior and includes a nozzle, the interior of which is spanned by a membrane that includes at least one score line defined therein. The cap includes a ring depending from and frangibly connected thereto, and includes a puncturing mechanism depending downwardly from a top thereof. Rotation of the cap in a first direction breaks the frangible connection between the cap and ring and causes the puncturing mechanism to puncture the membrane. In a preferred embodiment, the membrane includes a pair of intersecting score lines that tear when the membrane is punctured. In another preferred embodiment, the container closure assembly includes a leash that connects the cap and ring and that has a thickness and a width. The leash includes a hinge that comprises a portion of the leash that has a thinner thickness than the remainder of the leash, thereby allowing the leash to bend at the hinge.

26 Claims, 44 Drawing Sheets

U.S. PATENT DOCUMENTS 4,394,918 A * 7/1983 Grussen ..... 215/243
4,678,098 A * 7/1987 Oka ..... 220/289
4,790,453 A * 12/1988 Fontana et al. ..... 222/83
4,867,326 A 9/1989 O'Meara
5,052,589 A 10/1991 O'Meara
5,215,204 A * 6/1993 Beck et al. ..... 215/252
5,301,837 A 4/1994 O'Meara
5,402,901 A * 4/1995 Carvalheiro et al. ..... 215/252
5,419,459 A * 5/1995 O'Meara ..... 222/83
5,427,275 A 6/1995 Hansen
5,462,200 A 10/1995 Weiler
5,590,798 A 1/1997 O'Connell
5,667,094 A * 9/1997 Rapchak et al. ..... 220/834
5,725,115 A * 3/1998 Bosl et al. ..... 215/252
5,753,186 A * 5/1998 Hanley et al. ..... 422/101
6,000,848 A * 12/1999 Massioui ..... 383/80
6,039,218 A 3/2000 Beck
6,045,004 A 4/2000 Elliott
6,056,142 A 5/2000 Elliott
6,540,114 B1 4/2003 Popovich
6,886,716 B2 5/2005 Weiler
7,044,317 B2 5/2006 Smith
2003/0024947 A1 2/2003 Joshi
2004/0200855 A1 10/2004 Weiler
2005/0279761 A1 12/2005 Weiler

* cited by examiner

SHORTER

STANDARD

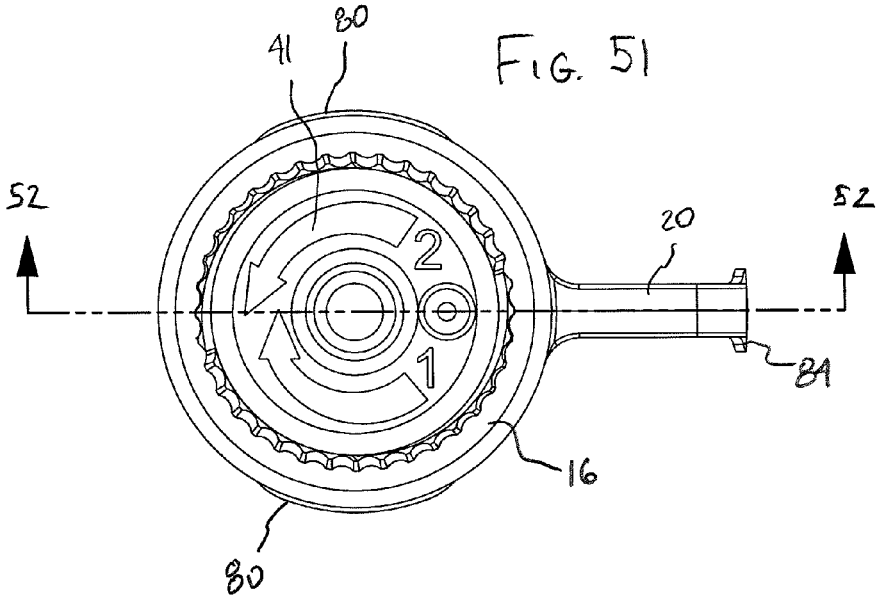
FIG. 51
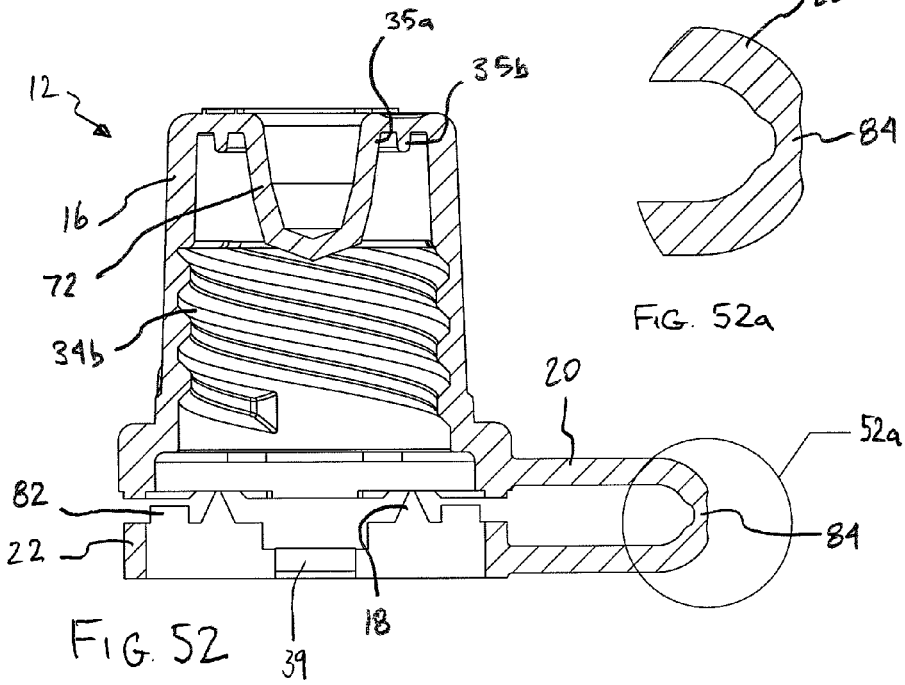
FIG. 52a
FIG. 52

CONTAINER CLOSURE ASSEMBLY

This application claims the benefit of U.S. Provisional Application No. 60/827,194, filed Sep. 27, 2006, which is herein incorporated by reference in its entirety.

FIELD OF THE INVENTION

The present invention relates to container closure assemblies, and more particularly to a container closure assembly that includes a flow control mechanism.

BACKGROUND OF THE INVENTION

The popularity of store bought beverages presents a number of issues in the beverage container industry regarding the container closure assemblies used for the containers. For example, evidence of tampering with the containers is a concern. Many different solutions, such as PVC shrink bands, plastic overwraps, dust covers and foil liners have been proposed. However, each of these create a loose part that has to be discarded. Also, some of these are difficult for the consumer to remove.

Another problem encountered is loose caps. First of all, losing a cap is an inconvenience to the consumer. Furthermore, a loose cap may be considered a small part or choking hazard to a child. Dust covers, loose caps, and anything solid that is a loose part could be considered a choking hazard, if it is deemed to be a Small Part under 16 CFR 1500 and 1501.

Another problem encountered with beverage containers, and, in particular, children's beverage containers, is spillage. Many beverages are highly viscous and spill easily when tipped over. This problem is particularly relevant when the beverage container is a flexible pouch. Flexible pouches are not rigid, have a less sturdy base, and are therefore more unstable and likely to tip over during normal use. Also, children have less motor control and are more likely to tip the flexible container over, which typically results in spillage.

Hygiene is also a concern in the beverage container industry. For example, many dispensing mechanisms, such as push pull spouts and twist up spouts have an exposed drinking orifice or require fingers to open the spout, which are unhygienic and subject to tampering.

One important aspect of a closure is maintaining seal integrity in the face of changes in environmental conditions, i.e. altitude, temperature, physical pressure (e.g., a truck driving from Arizona in the summer over the Rocky Mountains, which encounters extreme changes in temperature and altitude) create varying pressures on the inside of a container and tremendous stress on the closure, which must maintain an airtight seal in order to not allow ingress of microbiological contaminants or the egress of the product from the container. Either condition results in spoilage. Also, the physical nature of the liquid packaged can put stress on the closure.

For example, hot-fill pasteurized liquids are normally filled at 190° F. (~95° C.) or higher. This heat can cause distortion of the materials used to create the closure. Currently, this problem is solved using compression molded liners on the top of flat caps, foil liners, etc., which all help ensure an airtight seal is maintained. Also, for example, the gas released by carbonated beverages puts pressure on the closure.

Most (if not all) dispensing mechanisms, such as push pull spouts, twist up spouts, flip top caps, etc. are not airtight, which is why push pull spouts, for example, are common on bottled water and not on any other sort of beverage, certainly not a high quality, preservative free, beverage. This is also why beverages such as Propel™ and Gatorade™ have the foil liner on bottles that have the twist up dispenser but not on the bottles with the flat caps.

The amount of torque necessary (i.e., difficult for children and seniors) to open a screw cap on a bottle is a concern in the beverage industry. There are industry groups actively trying to figure out how to make screw caps more consumer friendly.

Accordingly, a need exists for a container closure assembly that overcomes the disadvantages described above.

SUMMARY OF THE PREFERRED EMBODIMENTS

In accordance with a first aspect of the present invention there is provided a two piece container closure assembly that includes a sleeve and a cap member. The cap member includes a cap that has a piercer extending downwardly from a top surface thereof that when twisted pierces a membrane in the nozzle of the cap, thereby allowing liquid to be dispensed from the container. The membrane preferably has a plurality of score lines defined therein that provide a plurality of flaps once the membrane has been pierced. The flaps cooperate to act as a flow control mechanism.

In accordance with another aspect of the present invention there is provided a method of dispensing a product from a container. The method includes the steps of providing a container having a container closure assembly associated therewith that includes a cap and a spout that is spanned by a membrane that includes at least one score line defined therein, moving the cap downwardly, puncturing the membrane to create an opening, removing the cap from the spout, and dispensing the product through the opening.

In accordance with another aspect of the present invention there is provided a container closure assembly that includes a base that is adapted to be connected to a container, a spout extending upwardly from the base, and a cap removably secured on the spout. The spout defines an interior and includes a nozzle, the interior of which is spanned by a membrane that includes at least one score line defined therein. The cap includes a ring depending from and frangibly connected thereto, and includes a puncturing mechanism depending downwardly from a top thereof. Rotation of the cap in a first direction breaks the frangible connection between the cap and ring and causes the puncturing mechanism to puncture the membrane. In a preferred embodiment, the membrane includes a pair of intersecting score lines that tear when the membrane is punctured. In another preferred embodiment, the container closure assembly includes a leash that connects the cap and ring and that has a thickness and a width. The leash includes a hinge that comprises a portion of the leash that has a thinner thickness than the remainder of the leash, thereby allowing the leash to bend at the hinge.

In accordance with yet another aspect of the present invention there is provided a container closure assembly that includes a base that is adapted to be connected to a container, but which is a separate component before being connected to the container, a spout extending upwardly from the base, and a cap removably secured on the spout. The spout defines an interior and includes a nozzle, the interior of which is spanned by a membrane. The cap includes a ring depending from and frangibly connected thereto, and includes a puncturing mechanism depending downwardly from a top thereof. Rotation of the cap in a first direction breaks the frangible connection between the cap and ring and causes the puncturing mechanism to puncture the membrane. In preferred embodiments, the base has a canoe-like shape and is connected to the interior of a pouch such that the spout extends upwardly from the pouch or the base comprises a flange that is adhered to a container such that the spout extends outwardly from the container.

In accordance with another aspect of the present invention there is provided a container closure assembly that includes a base that is adapted to be connected to a container, a spout extending upwardly from the base, and a cap removably secured on the spout. The spout defines an interior and includes a nozzle, the interior of which is spanned by a membrane that includes at least one slit defined therein. The cap includes a ring depending from and frangibly connected thereto, and includes a puncturing mechanism depending downwardly from a top thereof. Rotation of the cap in a first direction breaks the frangible connection between the cap and ring and causes the puncturing mechanism to puncture the membrane. In preferred embodiments, the membrane includes a plurality of intersecting slits defined therein or includes a plurality of slits defined therein that meet at a common point. Preferably, the plurality of slits are defined by a plurality of wedge shaped flaps.

In accordance with yet another aspect of the present invention there is provided a container that includes a container portion that contains a liquid therein, a spout extending outwardly from the container portion, and a cap removably secured on the spout. The spout defines an interior and includes a nozzle, the interior of which is spanned by a membrane that includes a plurality of flaps that cooperate to define a plurality of slits therein. The cap includes a ring depending from and frangibly connected thereto and a puncturing mechanism depending downwardly from a top thereof. The liquid in the container can only be dispensed through the slits by positive or negative pressure placed on the container portion.

In accordance with yet another aspect of the present invention there is provided a container that includes a container portion, a spout extending upwardly from the container portion, and a cap removably secured on the spout. The spout defines an interior and includes a nozzle, the interior of which is spanned by a membrane that includes at least one score line defined therein. The cap includes a puncturing mechanism depending downwardly from a top thereof. Rotation of the cap in a first direction causes the puncturing mechanism to puncture the membrane.

In accordance with another aspect of the present invention there is provided a container that includes a container portion, a spout extending upwardly from the container portion, a cap with a ring depending from and frangibly connected thereto removably secured on the spout, and a leash having a first end connected to the cap and a second end connected to the ring. The leash includes at least one hinge thereon.

In accordance with another aspect of the present invention there is provided a method of dispensing a product from a container, the method including the steps of providing a container having a cap removably secured on a spout, moving the cap downwardly, breaking a score line defined in a membrane that spans the interior of the spout to create an opening, removing the cap from the spout, and dispensing the product through the opening. In a preferred embodiment, the opening is a slit and the product is a liquid and the method further includes the step of tipping the container so that it is parallel to the ground. In this position, no liquid escapes from the opening.

BRIEF DESCRIPTION OF THE DRAWINGS

FIG. 51 is a top plan view of the cap member of FIG. 50;

FIG. 52 is a sectional side elevational view of the cap member of FIG. 50 taken along line 52-52 of FIG. 51;

FIG. 52*a* is a detailed view taken from the circle marked 52*a* in FIG. 52.

Like numerals refer to like parts throughout the several views of the drawings.

DESCRIPTION OF THE PREFERRED EMBODIMENTS

Figure 1:
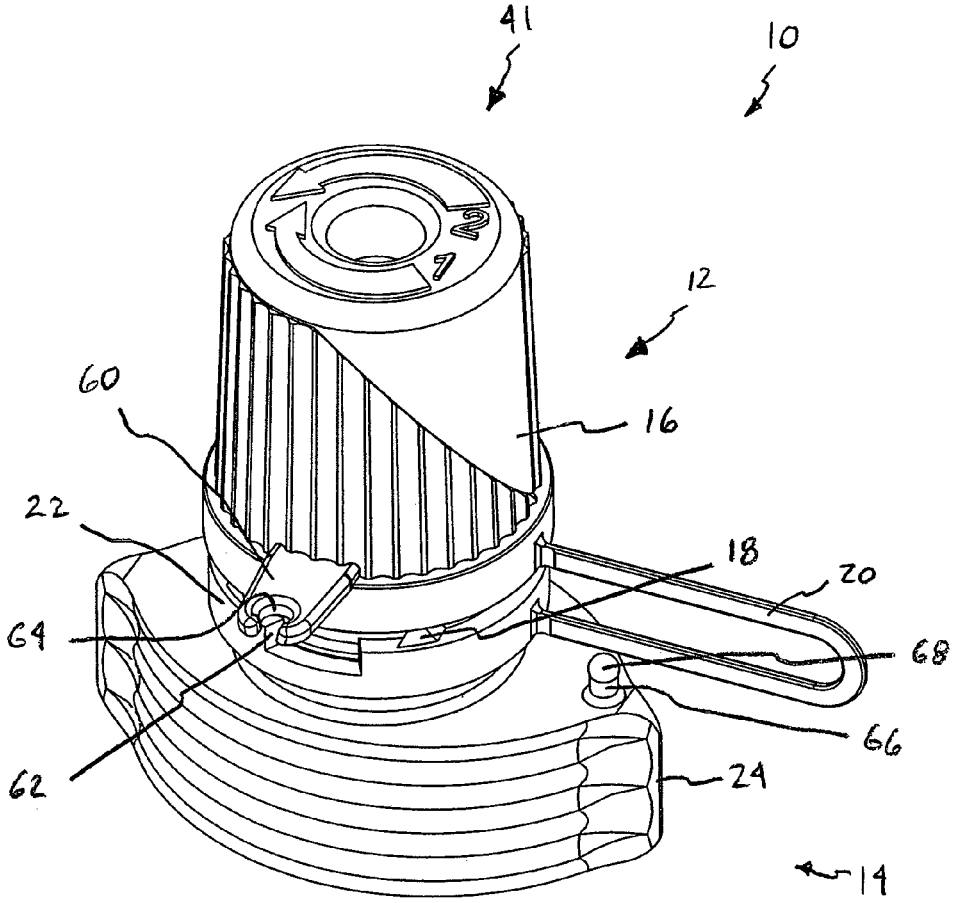
FIG. 1 is a perspective view of a container closure assembly with the cap member on the sleeve in accordance with a preferred embodiment of the present invention.
Figure 2:
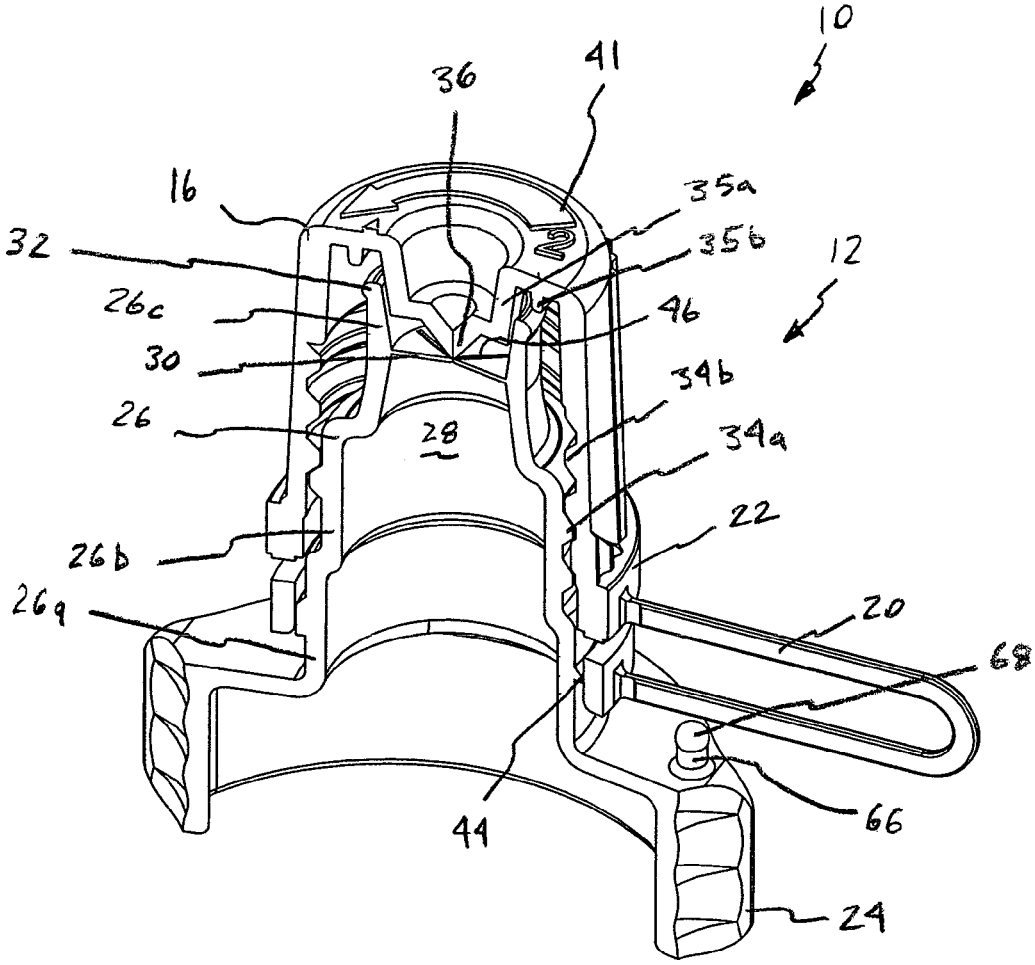
FIG. 2 is perspective cross-sectional view of the container closure assembly of FIG. 1.
Figure 3:
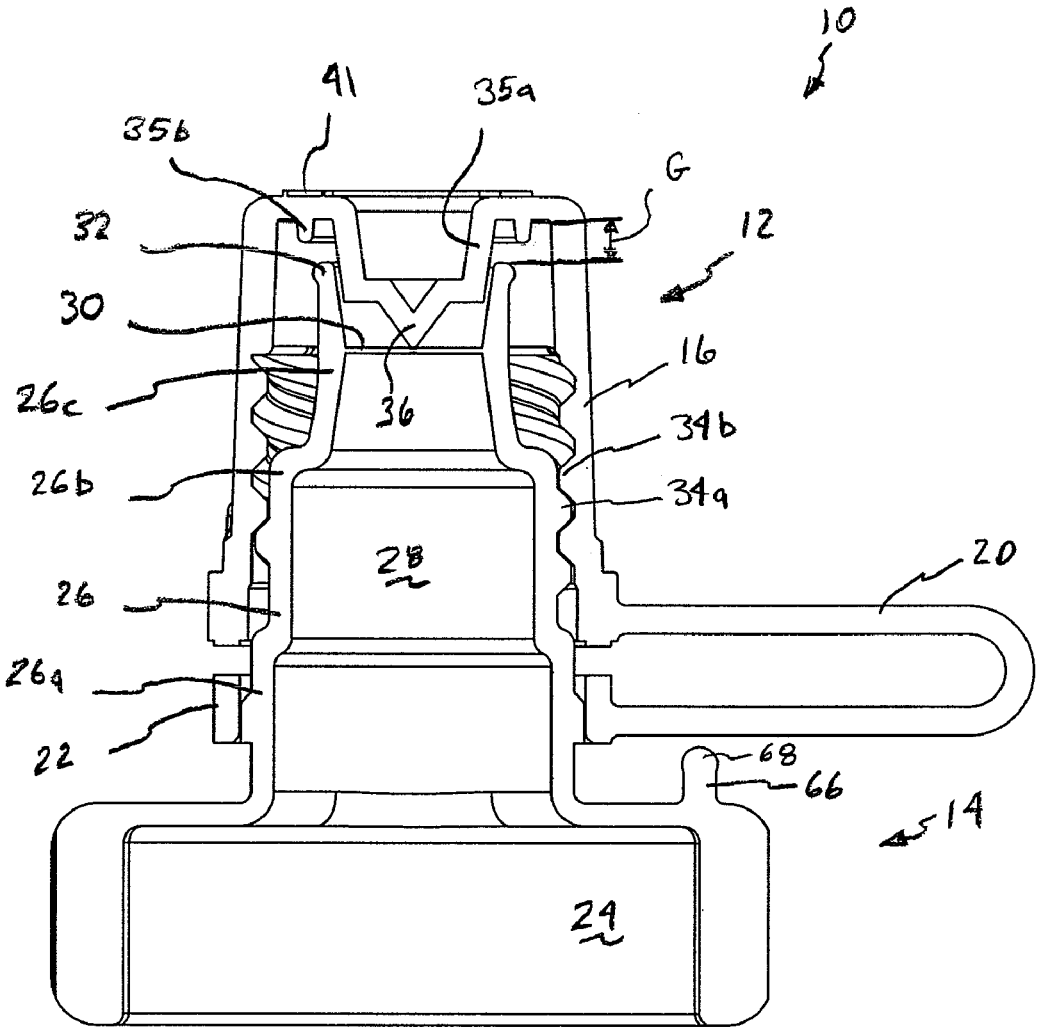
FIG. 3 is a sectional side elevational view of the container closure assembly of FIG. 1.

As shown in the drawings, for purposes of illustration, a preferred embodiment of the invention is a two piece container closure assembly for a beverage container.

For exemplary purposes only, described hereinbelow is a preferred embodiment wherein the container closure assembly is used with a flexible drinking container. However, this is not a limitation on the present invention. It will be understood that the container closure assembly can be used on other types of containers.

It will be appreciated that terms such as "front," "back," "top," "bottom," "side," "short," "long," "up," "down," and "below" used herein are merely for ease of description and refer to the orientation of the components as shown in the figures. It should be understood that any orientation of the container closure assembly, and the components thereof described herein is within the scope of the present invention.

Referring to FIGS. 1-9, the invention is embodied in a container closure assembly 10 for containers (sometimes referred to herein as container portion) 100 that include liquids or other products therein. The type of container 100 is not a limitation on the present invention. For example, the container can be plastic, paper or any other type of material that holds any product from water to juices to ketchup to health and beauty products, such as lotions, creams and pastes or industrial products, such as cleaning supplies, etc.

Figure 20:
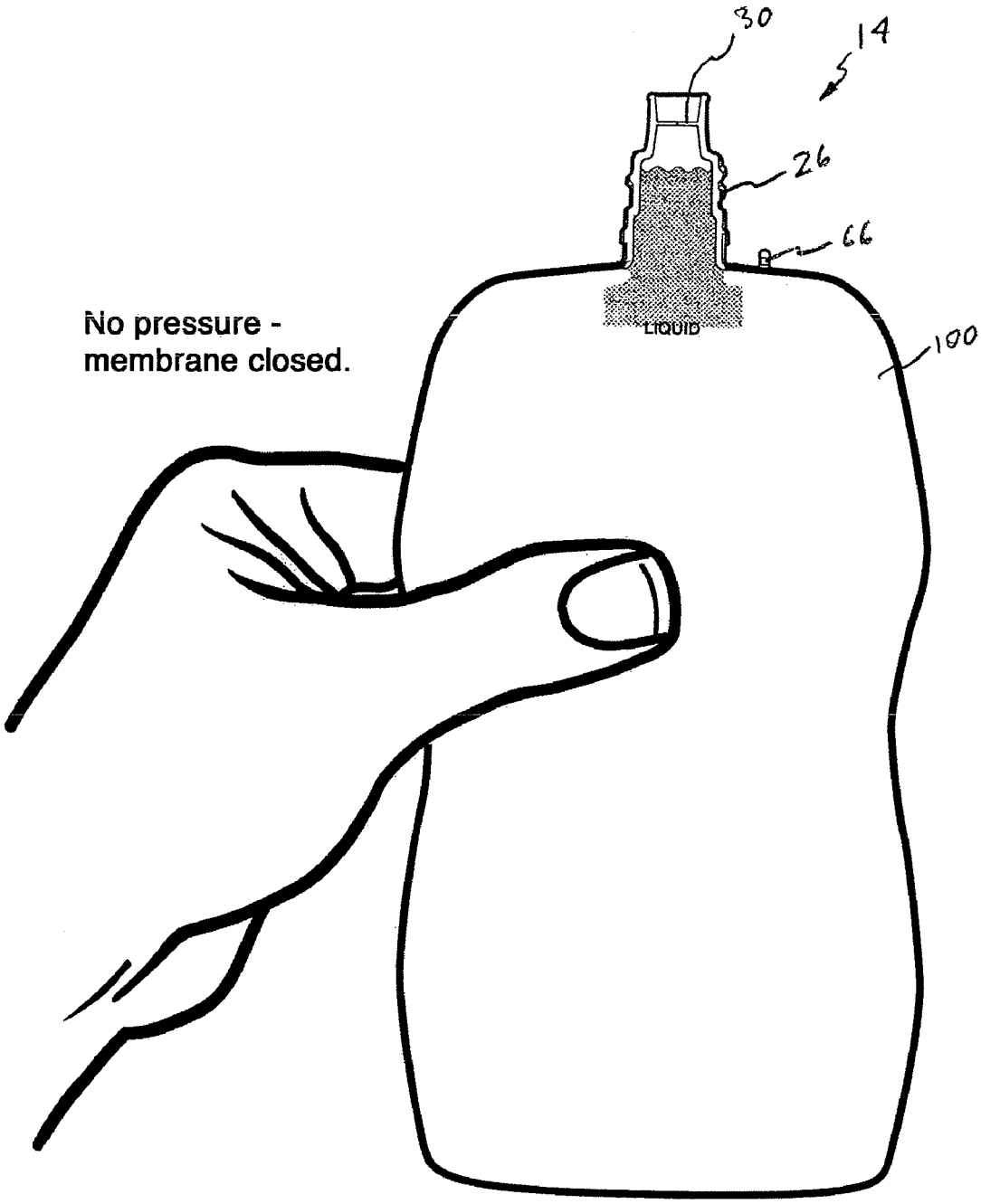
FIG. 20 is a side elevational view of a container with the sleeve of FIG. 1 thereon, showing no pressure being applied to the container.
Figure 21:
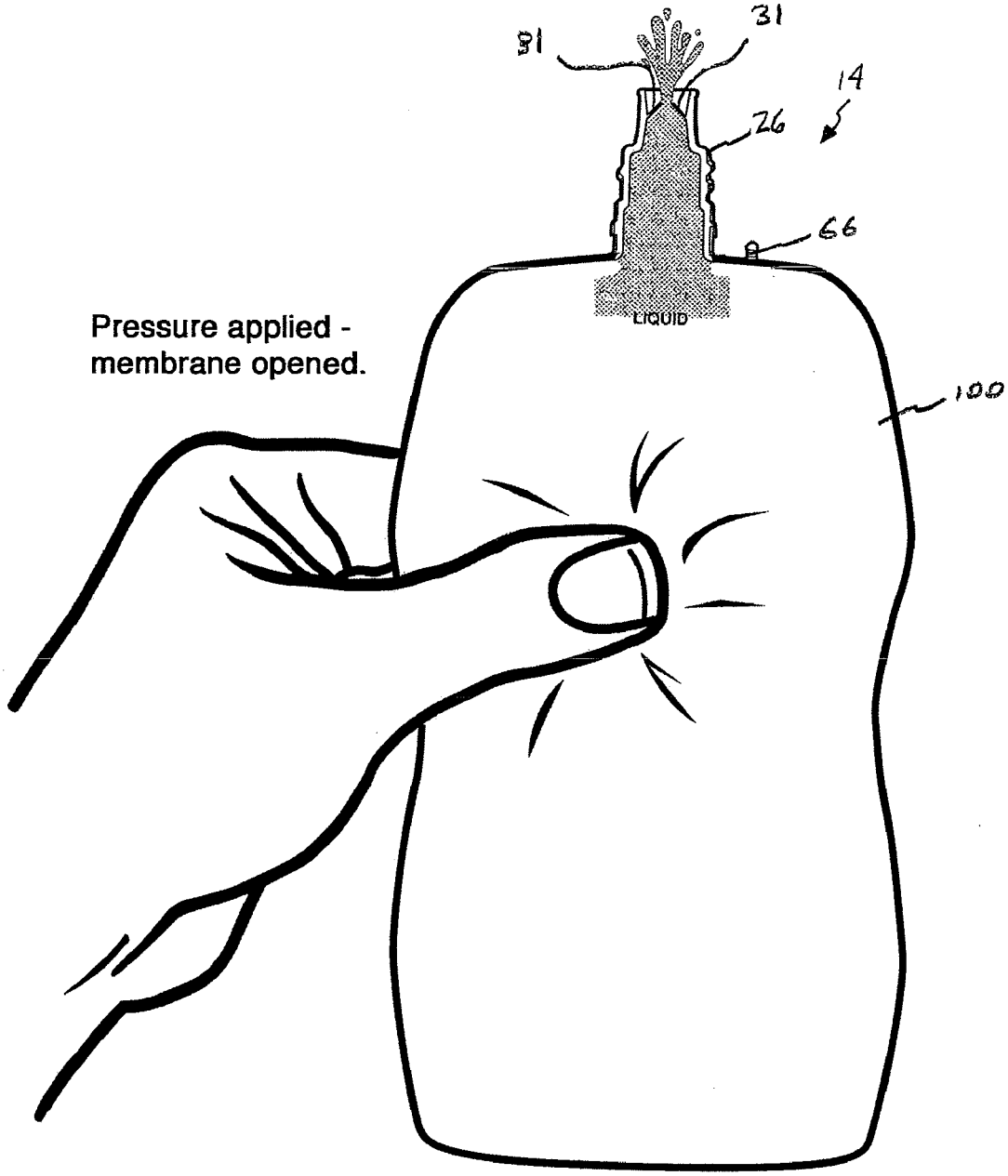
FIG. 21 is a side elevational view of a container with the sleeve of FIG. 1 thereon, showing pressure being applied to the container and liquid being dispensed therefrom.

In a preferred embodiment, container 100 is flexible, and container closure assembly 10 is secured or welded in place at the top of container 100, as is shown in FIGS. 20-21. It will be understood that the container closure assembly 10 can be located anywhere on the container 100, e.g., a corner, on the side, etc (see, e.g., FIGS. 42-43).

Container closure assembly 10 generally includes two interconnected parts, cap member 12 and sleeve 14. In a preferred embodiment, sleeve 14 is sealed to container 100 hermetically. This provides a unitary and hermetic package with no loose pieces. A hermetic seal is achieved when two materials are welded together to form a bond, eliminating the possible ingress or egress of gases into or out of the container through the seals. Methods of sealing are well known in the art and will be omitted here. However, as an example, sleeve 14 can be sealed to container 100 by heat sealing or ultrasonic sealing. In another embodiment, container closure assembly 10 can be secured in place in a potentially non-hermetic fashion, such as by gluing or the like.

Figure 4:
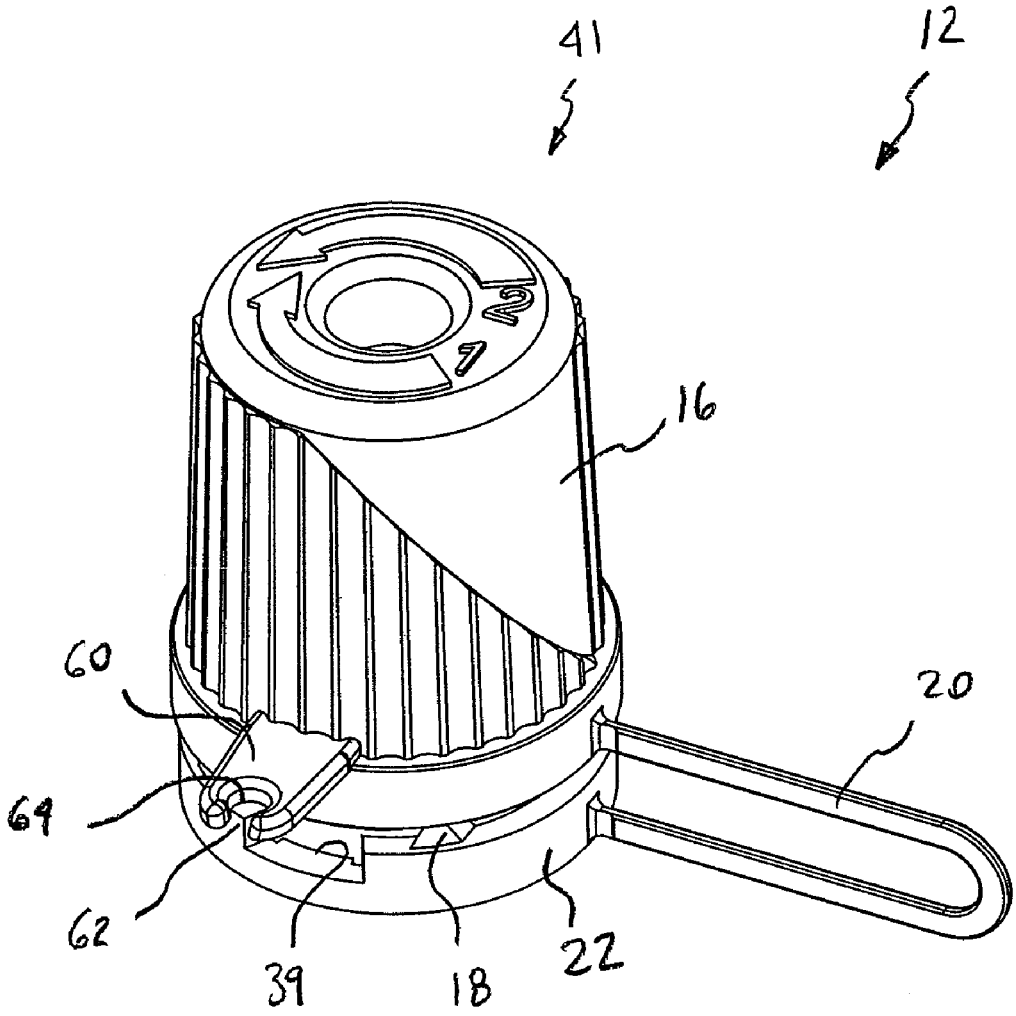
FIG. 4 is a perspective view of the cap member of FIG. 1.
Figure 5:
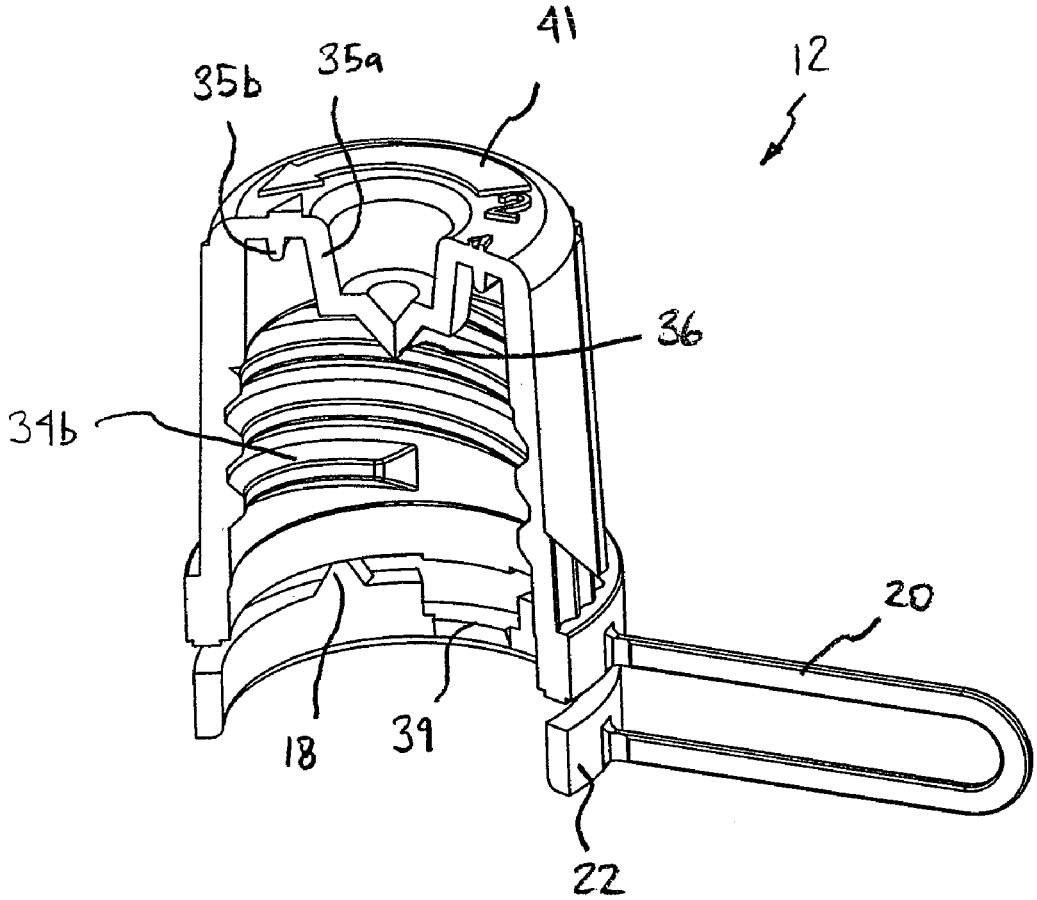
FIG. 5 is perspective cross-sectional view of the cap member of FIG. 1.
Figure 6:
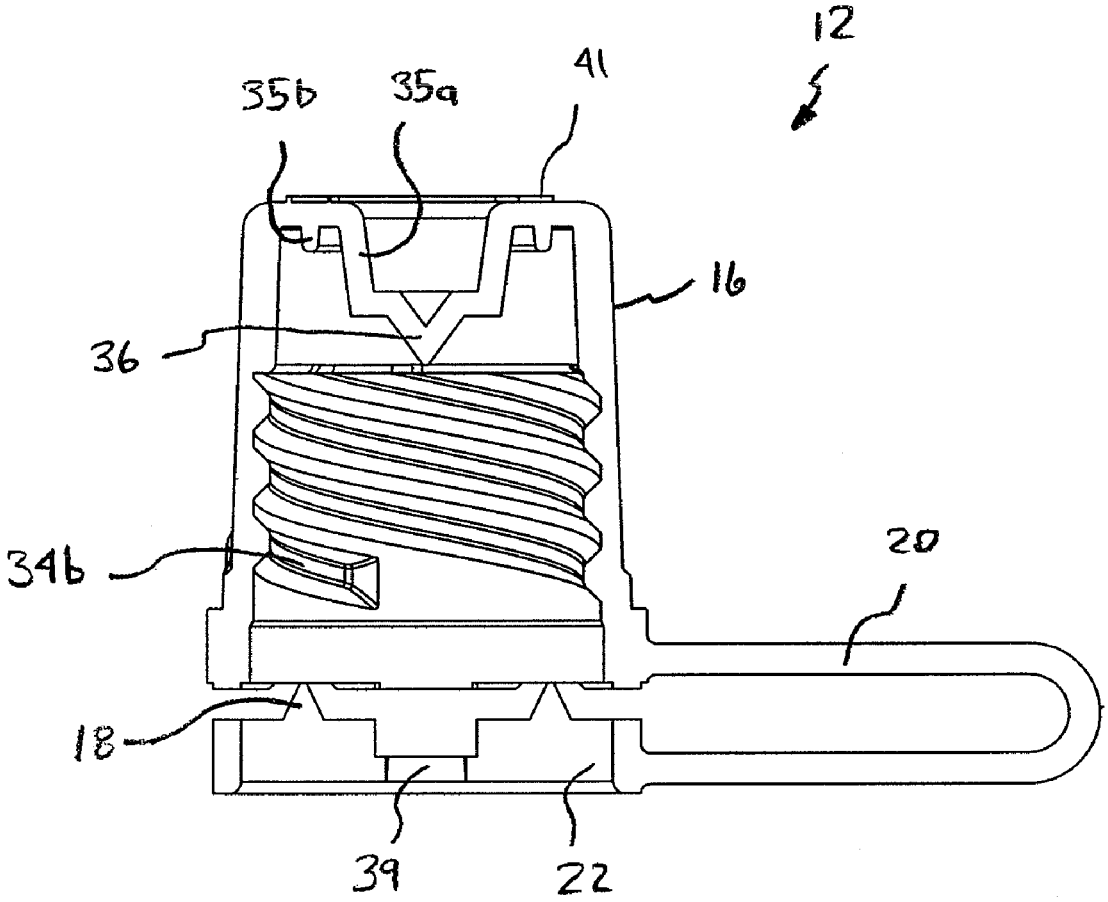
FIG. 6 is a sectional side elevational view of the cap member of FIG. 1.

With reference to FIGS. 4-6, in a preferred embodiment, cap member 12 includes an upper portion or cap 16 connected by tear tabs 18 and a tether 20 to a lower portion or ring 22. Tear tabs 18 are frangible, which allows upper portion 16 to be separated from lower portion 22, as will be described more fully below. In the illustrated embodiment, cap 16 is generally cylindrical and the exterior surface thereof optionally includes a plurality of serrations or grooves which facilitate gripping of the cap 16. Other configurations of gripping assists are within the scope of the invention as well.

Figure 7:
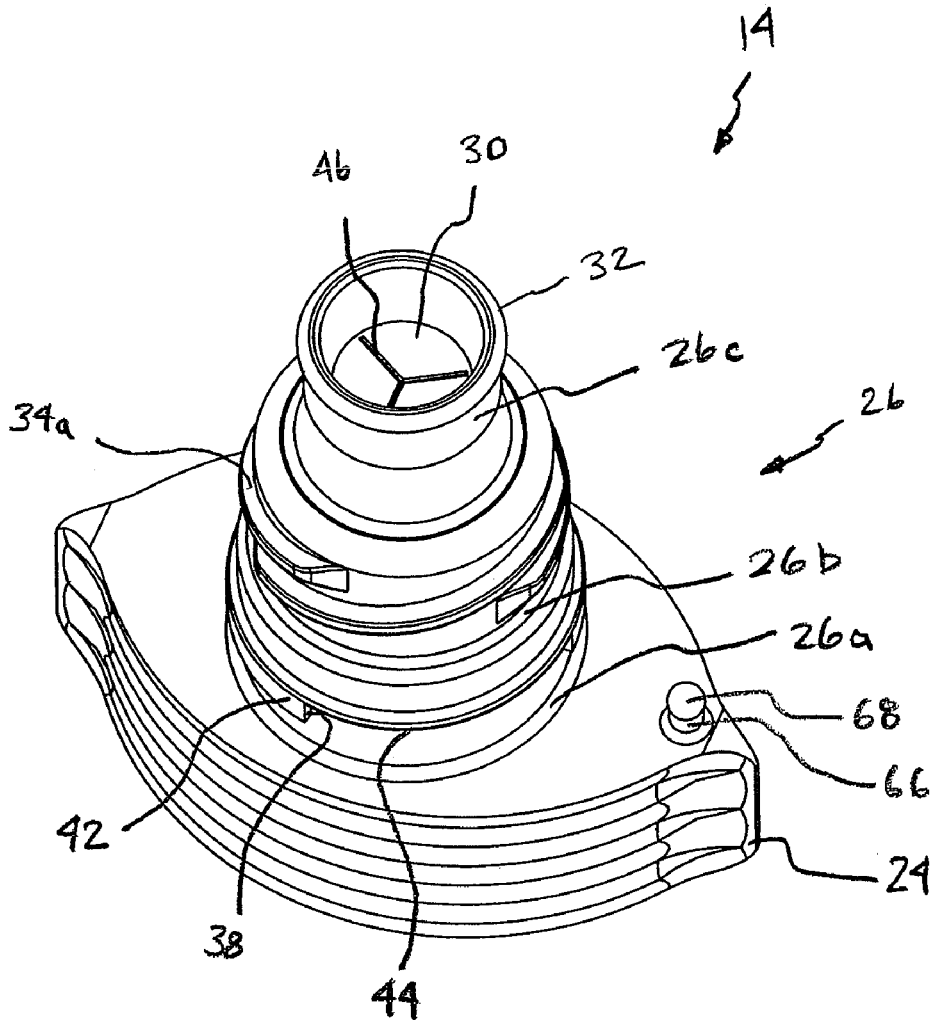
FIG. 7 is a perspective view of the sleeve of FIG. 1.
Figure 8:
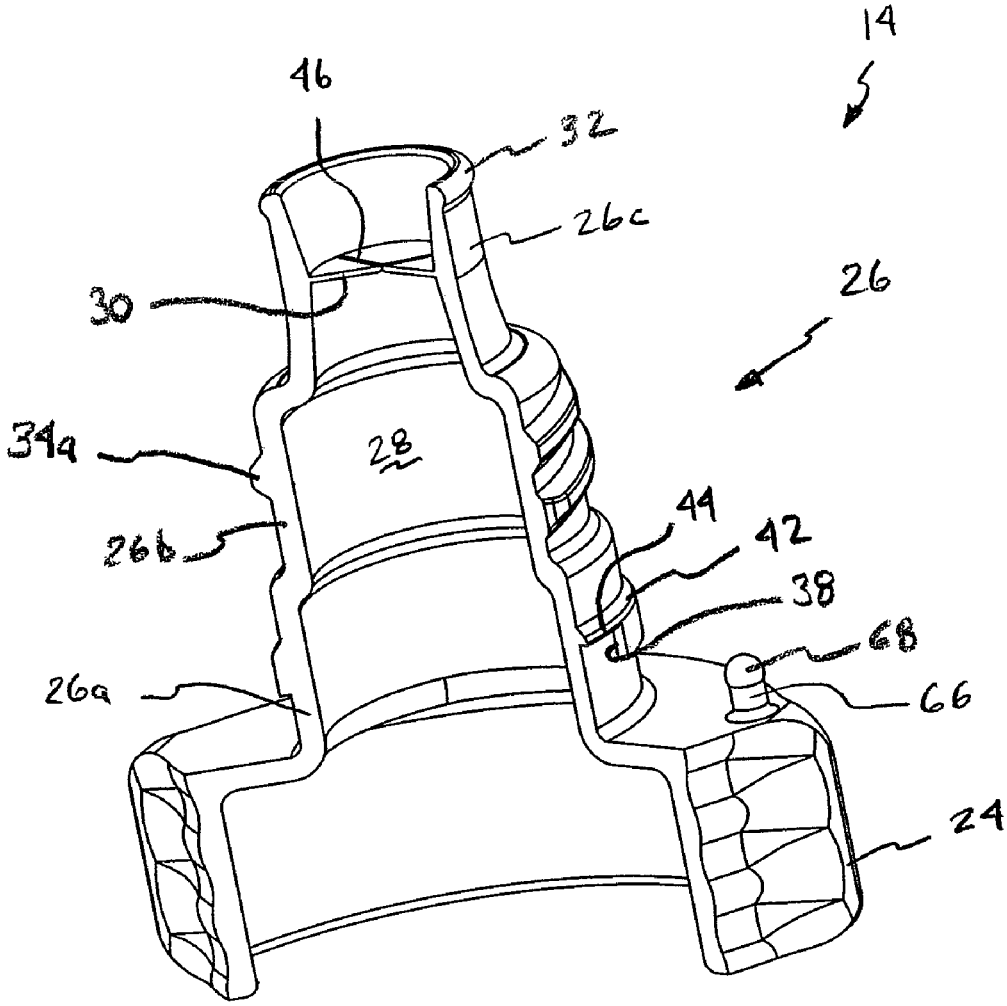
FIG. 8 is perspective cross-sectional view of the sleeve of FIG. 1.
Figure 9:
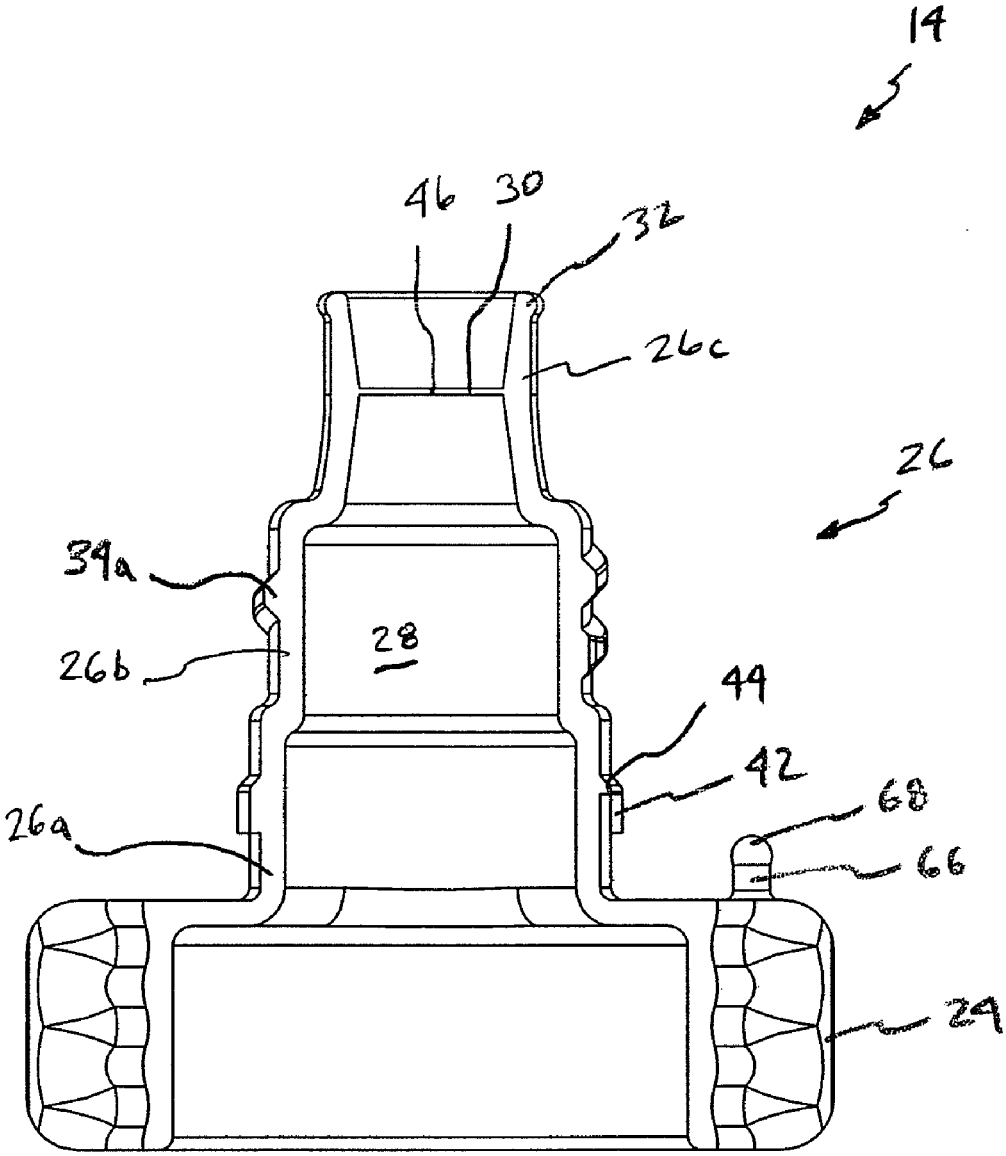
FIG. 9 is a sectional side elevational view of the sleeve of FIG. 1.

With reference to FIGS. 7-9, sleeve 14 includes a lower portion or fitment base 24 that is shaped and adapted to be sealed to container 100. As shown in the figures, fitment base 24 can have a canoe-type shape when viewed from the top or the bottom. This shape is advantageous for sealing to a flexible pouch or container. For example, the exterior surface of base 24 can be adhered to the interior surface of a flexible pouch near its top such that the spout 26 extends upwardly therefrom. However, this shape is not a limitation on the present invention. For example, fitment base 24 can be round, flat or oval shaped, etc (see, e.g., FIG. 37).

Extending upwardly from fitment base 24 is an upper portion or spout 26. Spout 26 is generally tubular in shape and defines an interior 28. The spout 26 generally includes a base portion 26*a*, an intermediate portion 26*b* and terminates in a unitary tapered nozzle 26*c* with a lip 32. However, nozzle 26*c* does not have to be tapered, it can be cylindrical, oval, or any other desired shape. External threads 34*a* are formed and extend circumferentially outwardly about the intermediate portion 26*b* of spout 26. Threads 34*a* can be left-handed or right-handed, as desired. Extending radially transversely across spout 26 is a membrane 30. As shown in FIG. 9, membrane 30 is preferably located in nozzle 26*c*, however this is not a limitation on the present invention. Membrane 30 can be located anywhere along spout 26 (the advantages of different membrane placements is described below). Membrane 30 preferably blocks the interior 28 of spout 26.

In a preferred embodiment, sleeve 14 and cap member 12 are made of high density polyethylene and/or polypropylene. In an exemplary embodiment, sleeve 14 is made of high density polyethylene and cap member 12 is made of polypropylene. However, neither of these are a limitation on the present invention. It will be understood that the components of the container closure assembly 10 can be made of any desired material, such as other plastics, rubbers, silicones, and other natural and synthetic materials, etc.

As discussed above, in a preferred embodiment, at least a portion of the exterior of spout 26 is provided with threads 34*a* (they do not necessarily have to be located on intermediate portion 26*b*) Likewise, at least a portion of the interior of cap 16 is provided with threads 34*b*. With this arrangement, cap member 12 can be threadingly engaged with spout 26. In a preferred embodiment, threads 34*a* and 34*b* are loose fitting threads because a tight fit to ensure a quality airtight seal is not necessary.

Figure 10:
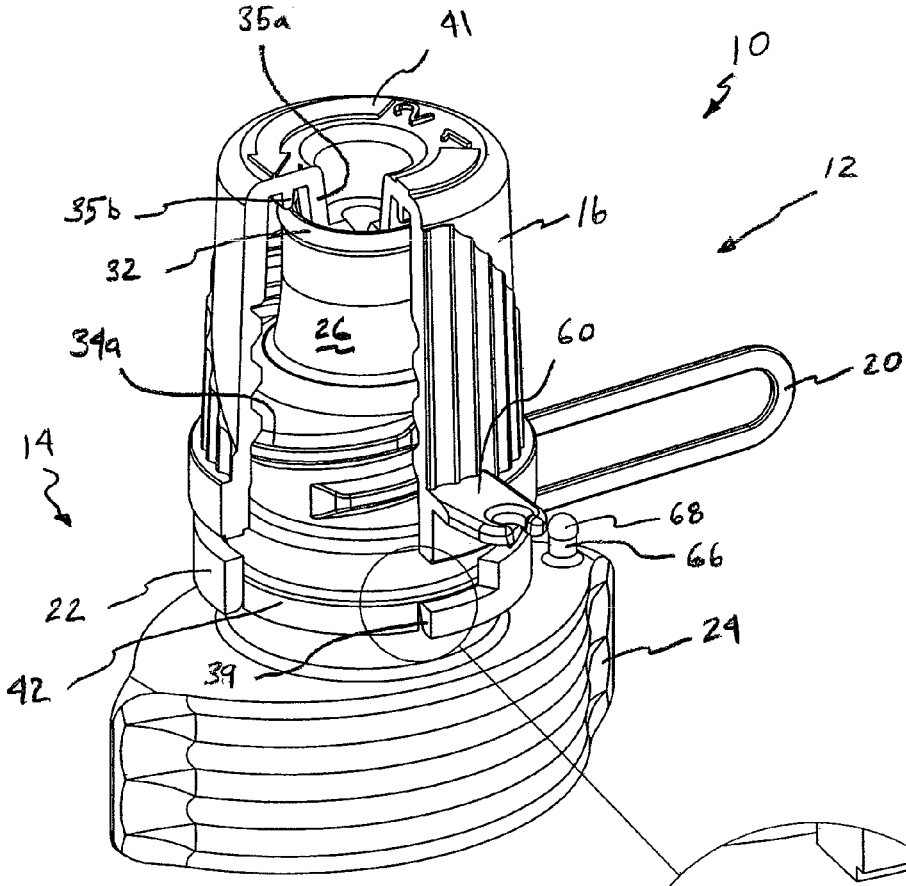
FIG. 10 is a perspective view of the container closure assembly of FIG. 1 with a portion of the cap member in section.
Figure 11:
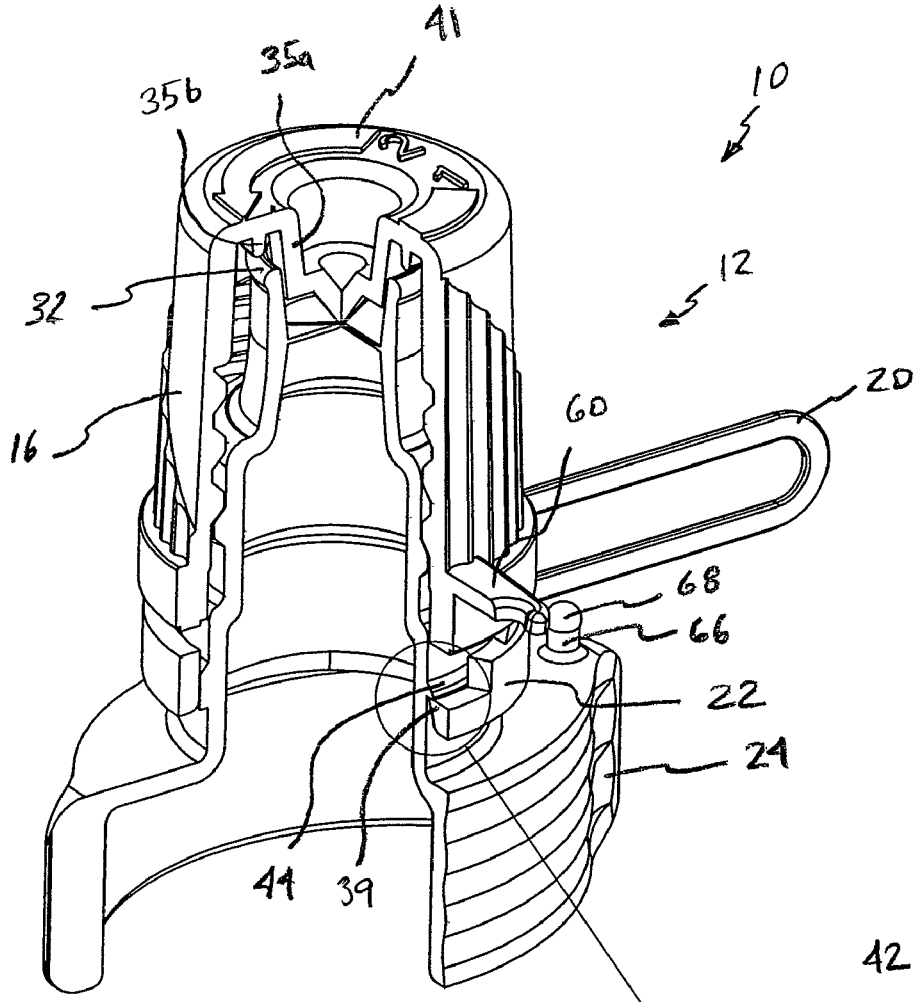
FIG. 11 is a perspective view of the container closure assembly of FIG. 1 with a portion of the cap member in section.
Figure 11A:
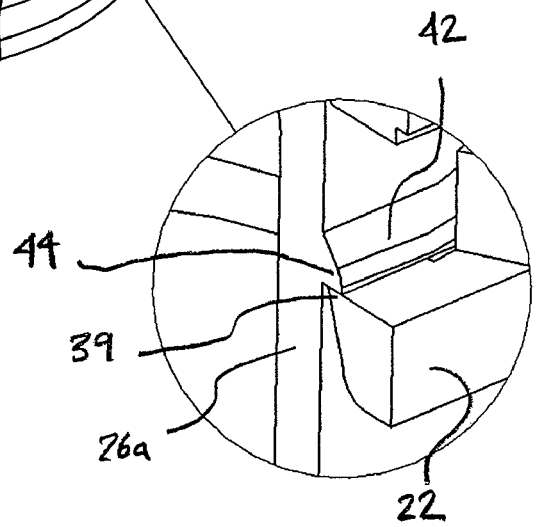
FIG. 11*a* is a detailed view showing how the tooth on the ring engages the guide on the sleeve.

With reference to FIGS. 10-11*a*, in a preferred embodiment, base 26*a* of spout 26 is provided with at least one and preferably a plurality of protrusions or vertically oriented blockers 38 on an exterior surface thereof that correspond to protrusions or teeth 39 on an interior surface of ring 22. In another embodiment, the teeth may be located on the top or bottom of ring 22.

Figure 10A:
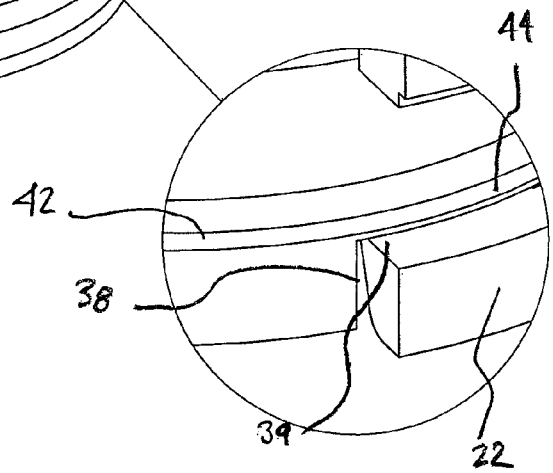
FIG. 10*a* is a detailed view showing how the protrusion on the sleeve abuts the tooth on the ring.

In the exemplary embodiment, vertically oriented blockers 38 are part of a protrusive ring 42 that extends around the circumference of base 26. As can best be seen in FIGS. 7 and 10, the protrusive ring 42 includes a plurality of vertically oriented blockers 38 and at least one horizontally oriented blocker 44. As best shown in FIG. 10*a*, the horizontally oriented blocker 44 abuts the upper surface of teeth 39 and prevents ring 22, and therefore cap member 12, from moving upwardly and coming off of spout 26 before tear tabs 18 have been broken.

Vertically oriented blockers 38 and teeth 39 are arranged such that when cap member 12 is twisted in either direction, at least one vertically oriented blocker 38 will abut and engage at least one tooth 39, thereby stopping the motion of the ring 22, breaking the frangible connection of the tear tabs 18 and separating the cap 16 from the ring 22. This provides a tamper evident mechanism. It will be appreciated that vertically oriented blockers 38 can be located anywhere on sleeve 14 or spout 26. Any tamper evident mechanism that provides a cap that is separated from a ring via a frangible connection is within the scope of the present invention.

In another embodiment, either of the vertically oriented blockers 38 and/or teeth 39 can be omitted. In this embodiment, the tear tabs 18 are broken by the twisting of cap 16 and the angular movement of cap 16 on the threads. For example, the vertically oriented blocker 38 for removing the cap 16 can be omitted.

It will be understood that tether 20 is provided to maintain cap 16 attached to ring 22, which remains on sleeve 14 when cap 16 is removed for dispensing the liquid or beverage from container 100. After tear tabs 18 have been broken, ring 22 preferably drops down and rests against fitment base 24. In this position, the teeth 39 are not in the circumferential path of the vertically oriented blockers 38. This allows the ring to twist freely about the base 26*a* of spout 26, thereby allowing tether 20 to twist with it.

Figure 12:
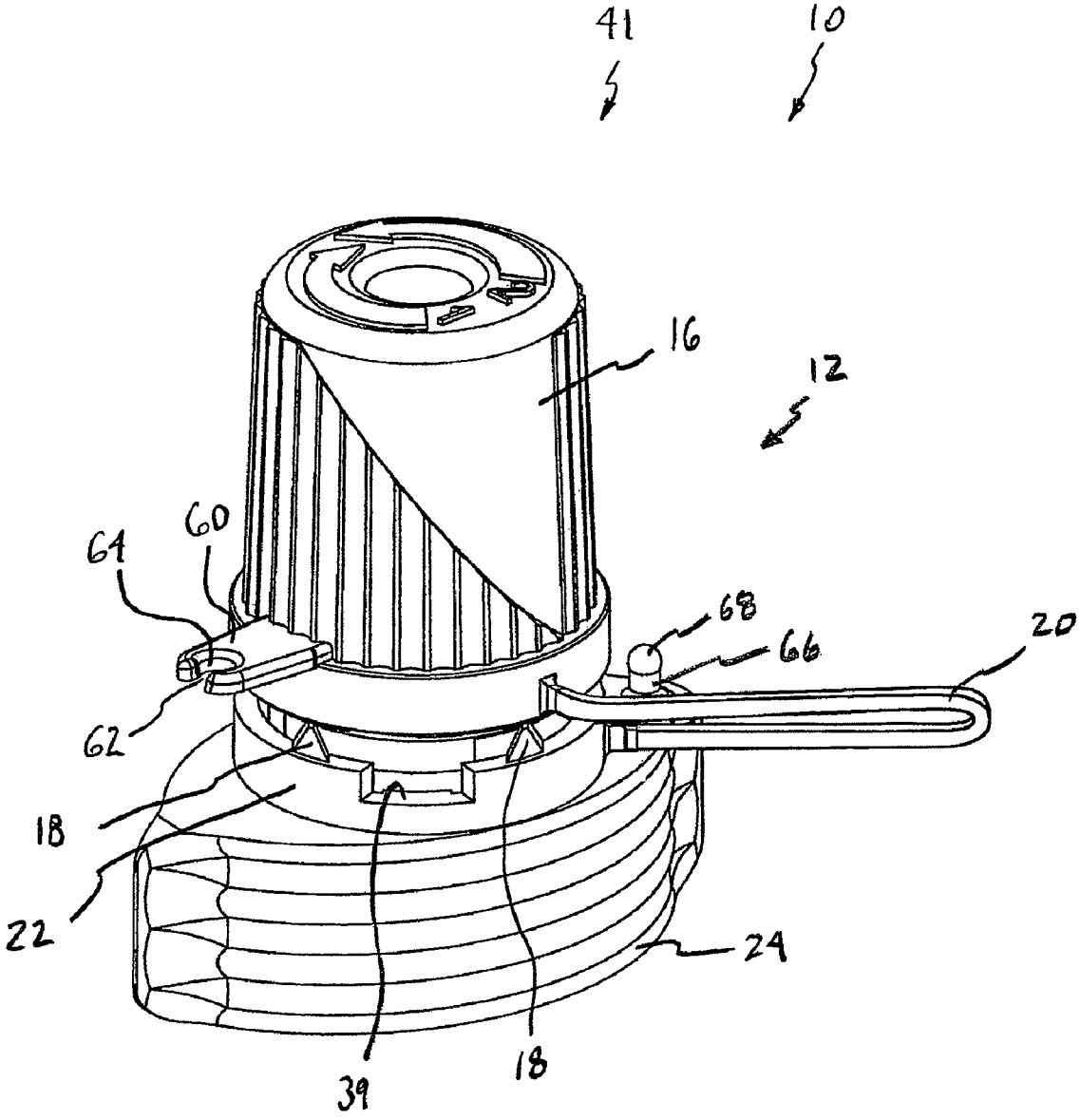
FIG. 12 is a perspective view of the container closure assembly of FIG. 1 showing the cap member after it has been slightly rotated and the tear tabs are about to break.
Figure 13:
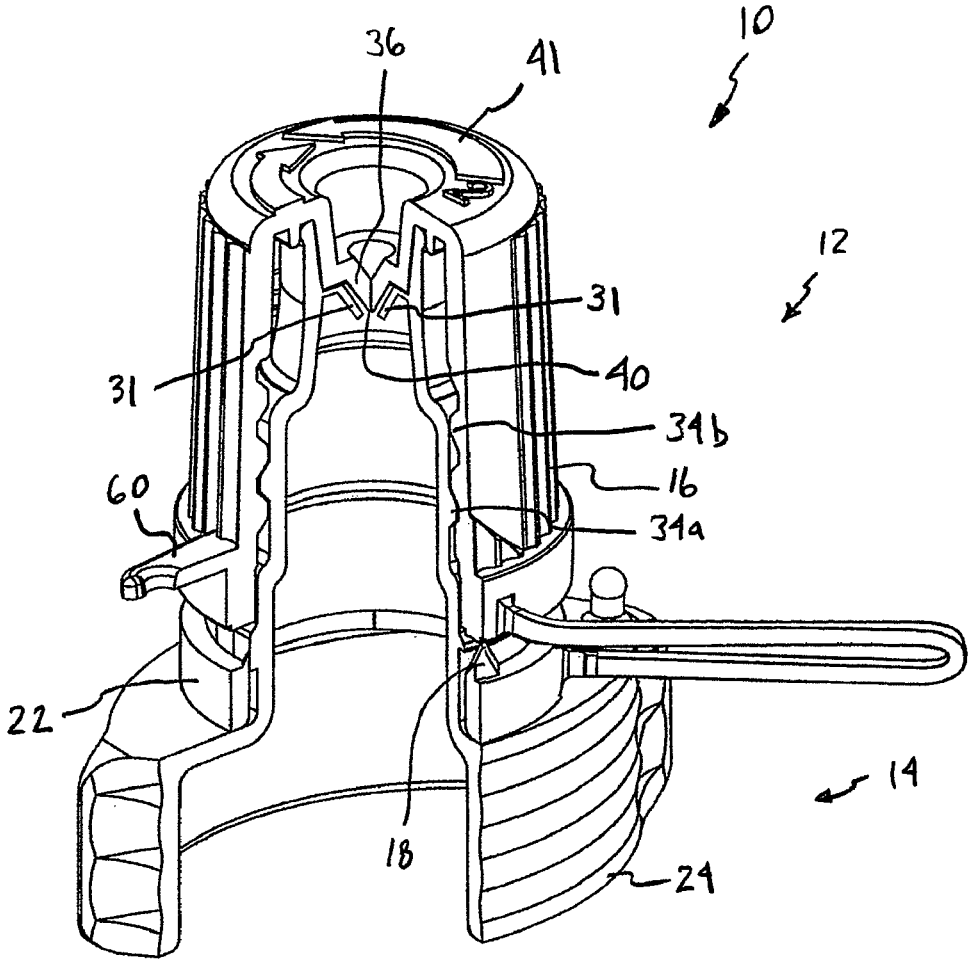
FIG. 13 is a perspective view of the container closure assembly of FIG. 1 with a portion of the cap member and sleeve in section showing the cap member after it has been rotated, the tear tabs are broken and the membrane has been pierced.
Figure 14:
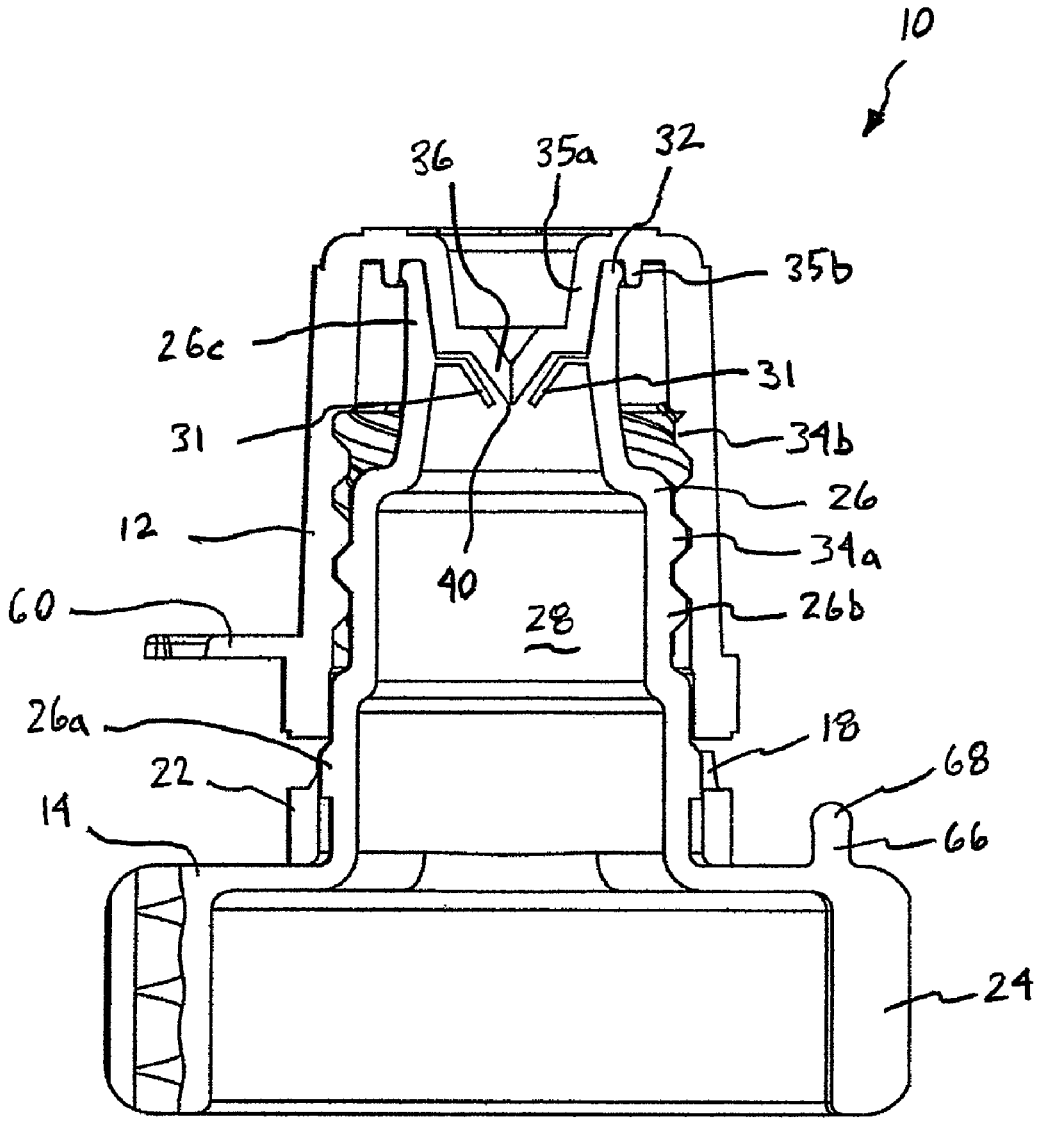
FIG. 14 is a sectional side elevation of the container closure assembly of FIG. 1 showing the cap member after it has been rotated, the tear tabs are broken and the membrane has been pierced.

As shown in FIG. 11, cap 16 includes a spike, piercer or puncturing mechanism 36 extending downwardly from the top of cap 16. As will be described more fully below, piercer 36 is adapted to pierce or puncture membrane 30. It will be understood by those skilled in the art that the piercer does not need to be sharp to pierce the membrane. In another embodiment (described below) it can be blunt or flat. With reference to FIGS. 12-14, in operation, to pierce membrane 30, cap 16 is twisted so that threads 34*a* and 34*b* cause cap 16 to travel downwardly. In a preferred embodiment, the cap 16 is initially positioned on threads 34*a* and 34*b* so that it is has the ability to travel downwardly or upwardly. This is evidenced by gap G in FIG. 3. FIGS. 12-14 show cap 16 after it has been twisted. As can be seen in FIG. 12, at this point, the top portion of tether 20 is no longer aligned with the bottom portion of tether 20. When twisted, as cap 16 moves downwardly, piercer 36 contacts and pierces membrane 30, thereby causing an opening 40 to be formed therein. As can be seen in FIG. 14, at this point, gap G is no longer visible. Accordingly, before piercing of membrane 30, the liquid in the container 100 remains hermetically sealed therein. After piercing, the liquid can then be dispensed through opening 40.

Cap 16 preferably includes a pair of sealing rings 35*a* and 35*b* that cooperate with nozzle 26*c* and, in particular, lip 32, to provide a seal that prevents liquid from escaping from interior 28. This provides a resealable container. For example, in FIG. 3, after the cap 16 is opened the package can be resealed. Outer sealing ring 35*b* and inner sealing ring 35*a* form a leakproof seal when screwed down on spout 26 and lip 32. Gap G is eliminated as spout 26 is sandwiched between sealing rings 35*a* and 35*b*.

In a preferred embodiment, cap 16 is twisted downwardly such that tear tabs 18 are broken at approximately the same time as membrane 30 is pierced. This single motion is convenient for users of the container closure assembly 10. As shown in FIG. 1, cap 16 can include markings 41 thereon that show the proper way to open container 100. As shown, the markings 41 can include an arrow with "1" (as in "step 1") to show that the cap 16 should be turned clockwise initially to break the tear tabs 18 and pierce the membrane 30 and then another arrow with a "2" (as in "step 2") to show that cap 16 should then be twisted counter-clockwise to remove cap 16 from spout 26 so that the liquid can be dispensed.

Figure 15:
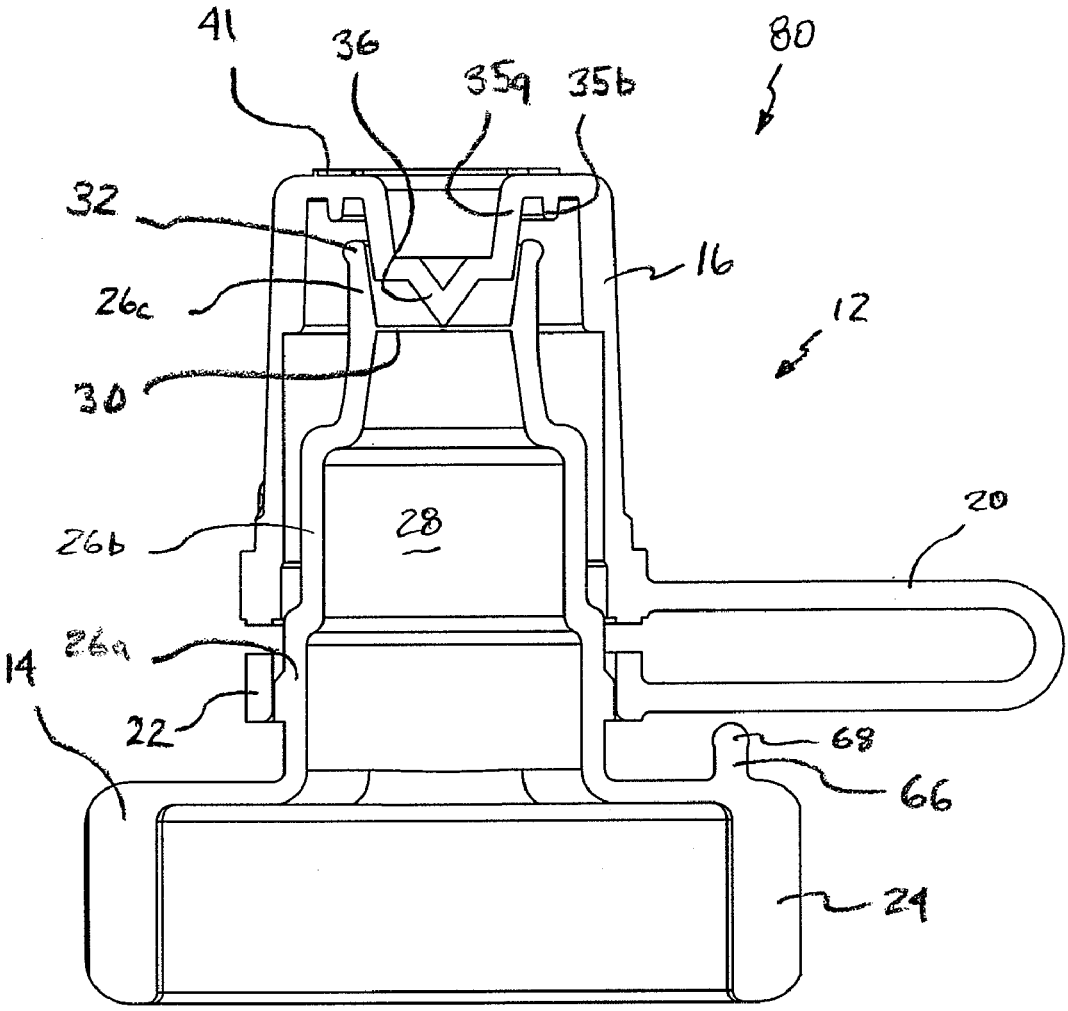
FIG. 15 is a sectional side elevational view of a container closure assembly that is non-threaded in accordance with another preferred embodiment of the present invention.
Figure 16:
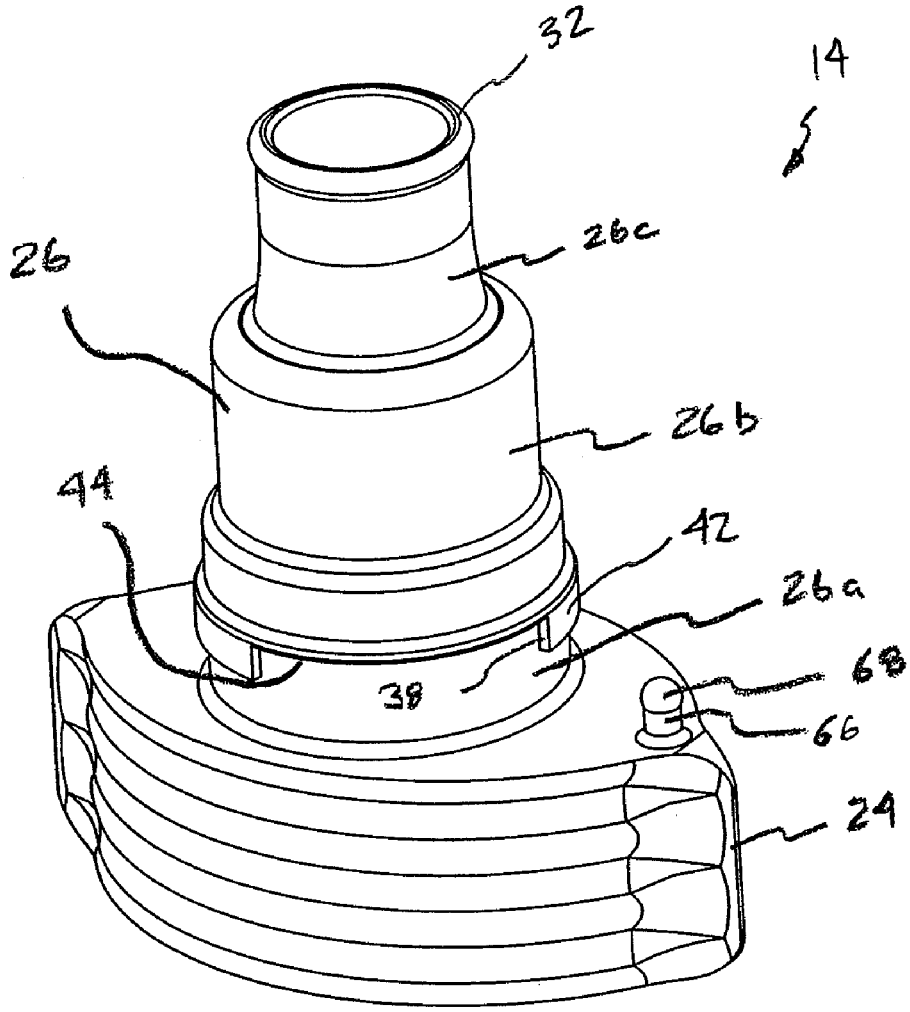
FIG. 16 is a perspective view of the sleeve of FIG. 15.

In an alternative embodiment, as is shown in FIGS. 15-16, a container closure assembly 80 can be provided in which the threads are omitted. In this embodiment, the cap 16 can have a press fit or similar arrangement with the spout 26. For example, spout 26 can include ribs that are engaged with corresponding ribs or the like on cap 16 to keep cap 16 in place as desired. To pierce membrane 30, the cap 16 is pressed downwardly.

In a preferred embodiment, container 100 is a flexible pouch with non-rigid walls that collapse under pressure and do not provide a counter displacement pressure (i.e., container 100 does not return to its original shape after dispensing). This type of container causes liquid to flow freely at a high flow rate. This high flow rate creates the need for some type of flow control in some instances.

With reference to FIGS. 17*a*-21, in a preferred embodiment, membrane 30 is designed such that after piercing, membrane 30 becomes a flow control mechanism. As best shown in FIGS. 17*a*-17*e*, in a preferred embodiment, membrane 30 includes a plurality of welds or score lines 46 therein. The score lines 46 can be molded into membrane 30 during manufacture or can be formed in membrane 30 after manufacture. A flow control mechanism provides many advantages. For example, it can prevent spillage if the container is upturned. Membrane 30 can be designed to provide high, moderate or low flow rates as desired. For example, in a children's beverage container it may be desirable to provide a check valve so that when container 100 is tipped there is no or little flow through spout 26 unless pressure is exerted on the contents. The pressure can be applied by squeezing container 100 (positive pressure) or sucking the contents out of container 100 (vacuum pressure or negative pressure) FIGS. 18-21 illustrate the action of membrane 30 and flaps 31 when pressure is applied to container 100 or the liquid therein. FIGS. 20-21 show a container 100 that includes container closure assembly 10. In FIG. 20, membrane 30 has been pierced, however, the flaps 31 of membrane 30 are closed. In FIG. 21, pressure is being applied to container 100, thereby causing the flaps 31 to open upwardly, and allowing the liquid in container 100 to be dispensed. This action of the flaps 31 can be achieved by the selection of an appropriate membrane material. For example, silicone, such as medical grade silicon, may achieve this.

The configuration of score lines 46 help determine the desired flow rate. Welds or score lines 46 are preferably quite thin. Therefore, in operation, when piercer 36 punctures membrane 30, it tears score lines 46, thereby creating a plurality of flaps 31. For example, in FIG. 17*a*, membrane 30 includes three score lines 46 that, after being torn, create three flaps 31. In use, score lines 46 will likely also be torn more completely by squeezing or sucking pressure during drinking. In a preferred embodiment, piercer 36 has a generally triangular shape which expands the tearing of score lines 46 as it moves downwardly, thereby creating flaps 31.

Figures 17A, 17B, 17C, 17D, 17E:
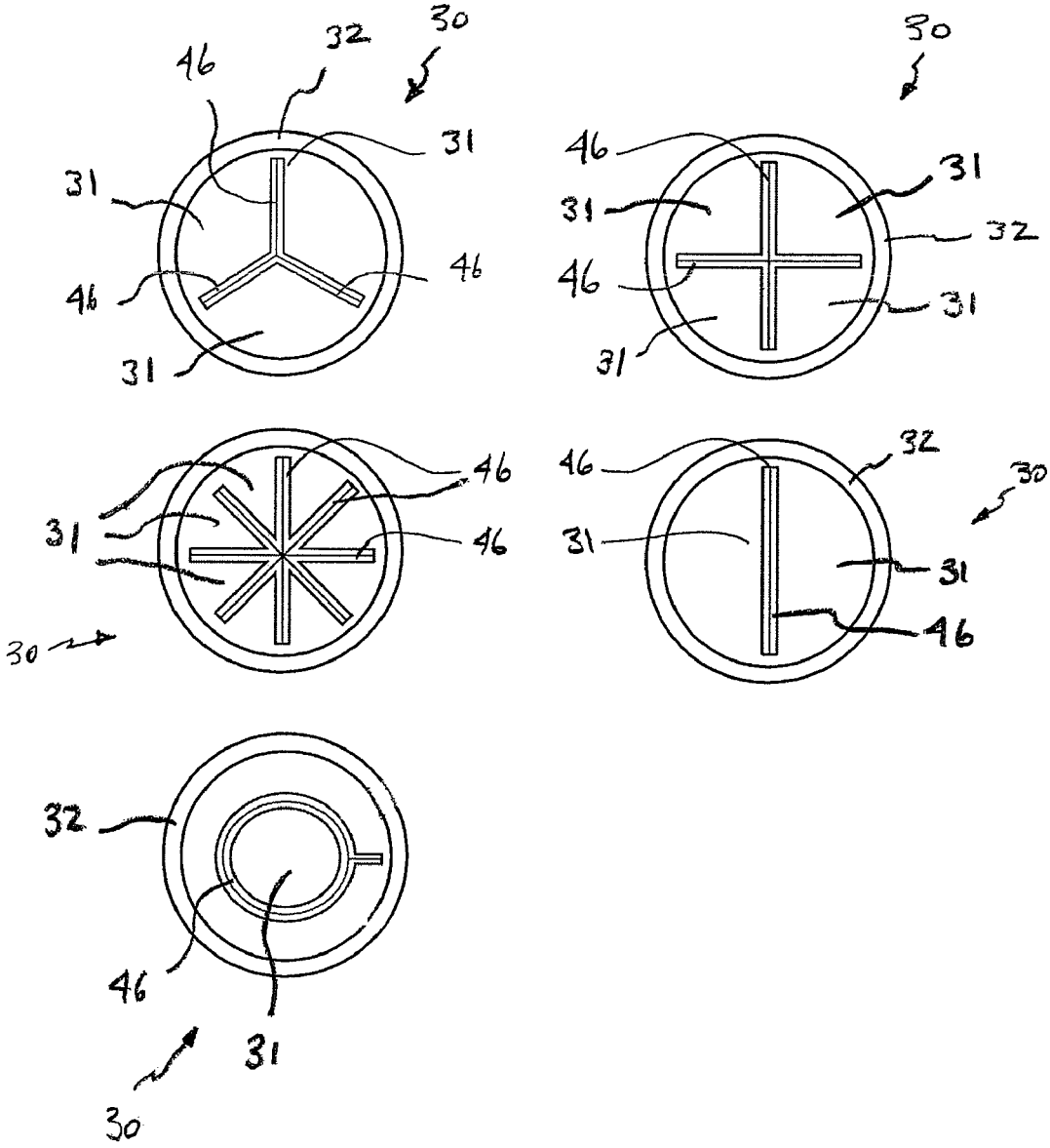
FIG. 17*a*-17*e* are a series of top plan views of the membrane and welds in accordance with a number of preferred embodiments of the present invention.
Figures 18, 19:
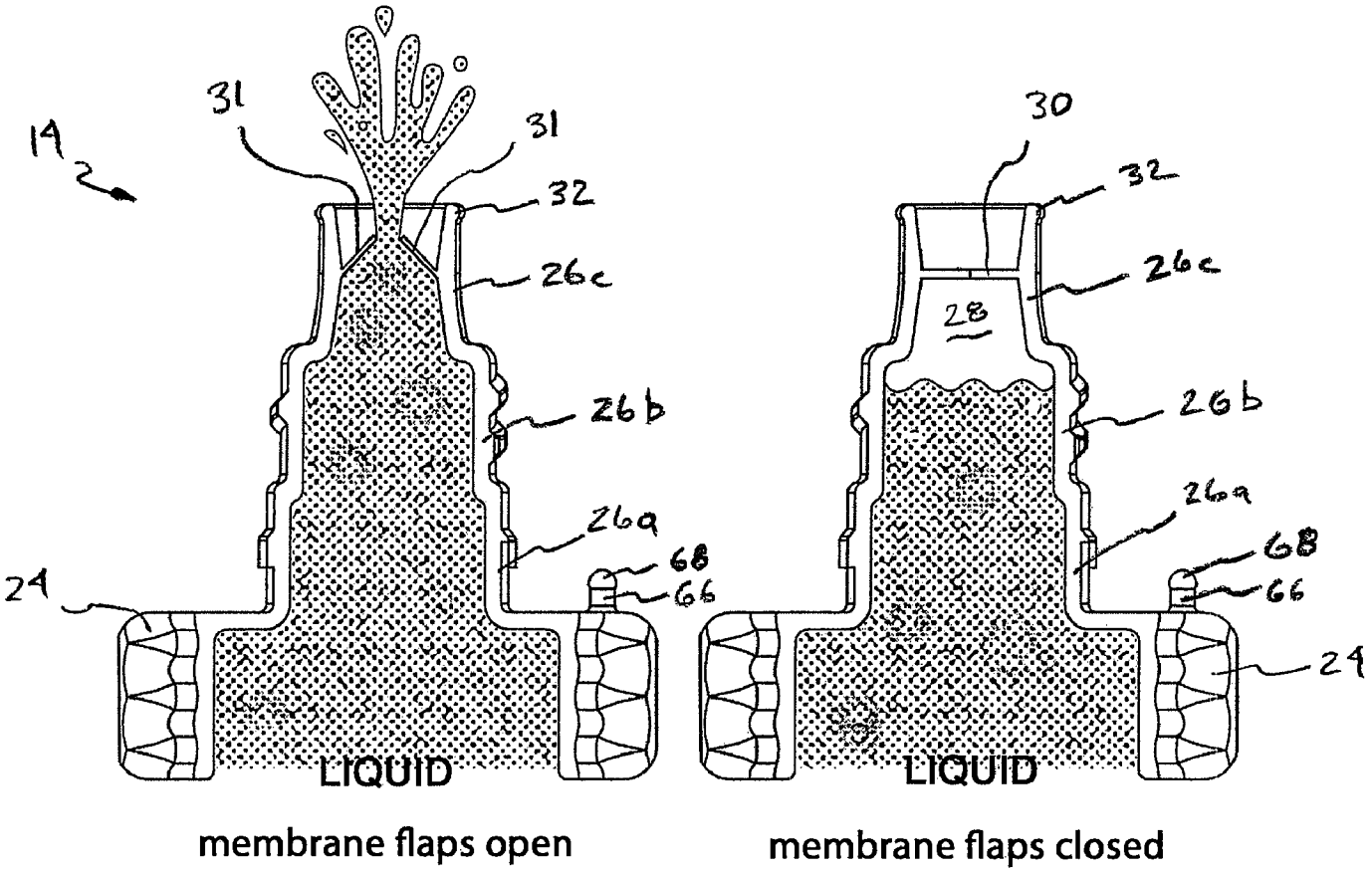
FIG. 18 is a sectional side elevational view of the sleeve of FIG. 1 with the flaps oriented upwardly as a result of pressure and liquid flowing therefrom.
FIG. 19 is a sectional side elevational view of the sleeve of FIG. 1 with the flaps closed, thereby preventing liquid therein from being dispensed.

FIGS. 17*a*-17*e* show a number of exemplary embodiments of membrane 30 and welds 46 thereon. Score lines 46 can meet at their ends or at a common point, as shown in FIG. 17*a*. Score lines 46 can intersect, as shown in FIGS. 17*b* and 17*c* (of course, this could also be considered meeting at a common point). A single score lines 46 can be used, as shown in FIG. 17*d*. It will be understood that after membrane 30 has been punctured, the score lines 46 become slits that are defined by the flaps 31.

FIG. 17*e* shows a round weld 46 that works similar to a flapper valve on inflatable balls or rafts. It will be understood that any configuration of score lines 46 is within the scope of the present invention.

Those skilled in the art will recognize that a number of different factors determine the flow rate. For example, the thickness of membrane 30, and therefore flaps 31, helps determine flow rate. The surface tension of the subject liquid also helps determine flow rate. For example, a viscous liquid like a drinkable yogurt or smoothie has a higher surface tension than water or lemonade.

Figure 22:
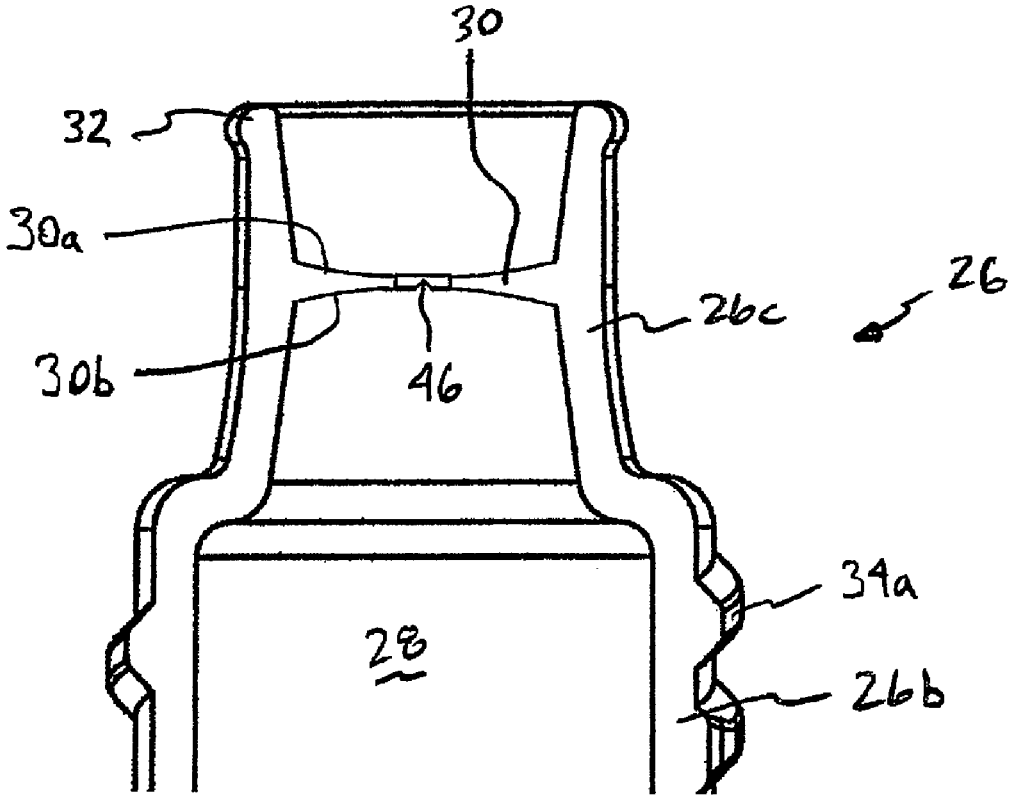
FIG. 22 is a sectional side elevational view of a portion of the spout showing the membrane in accordance with a second preferred embodiment of the present invention.
Figure 23:
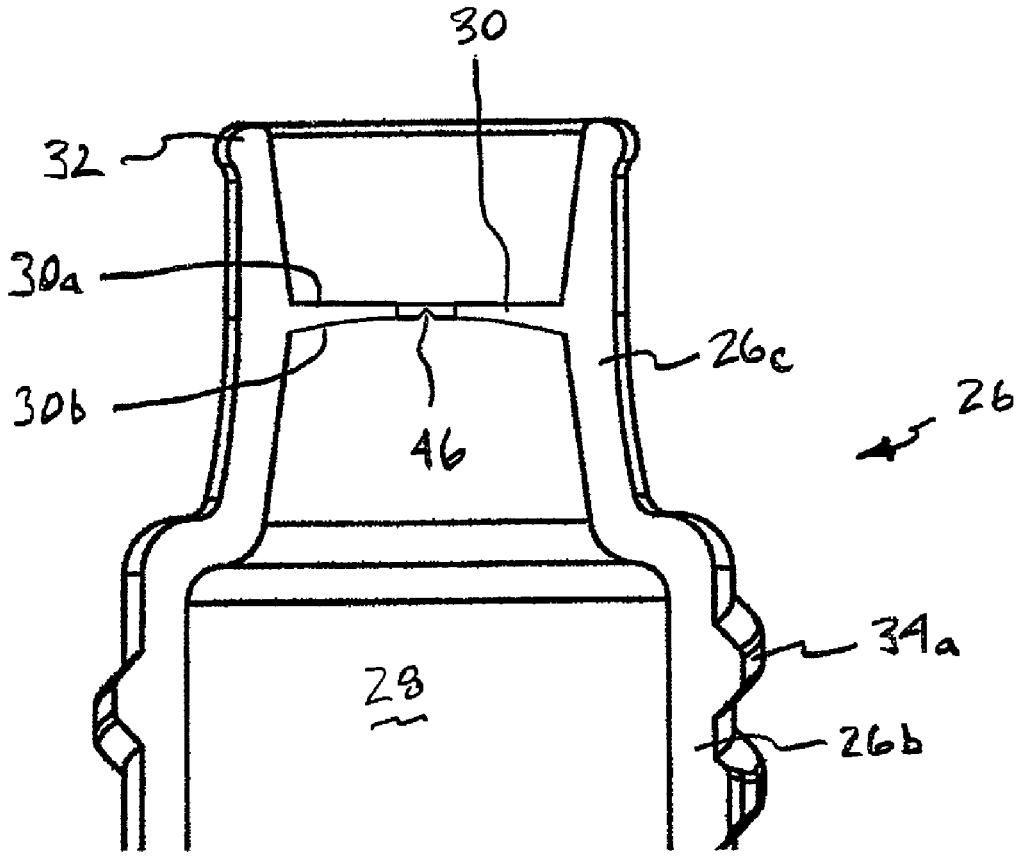
FIG. 23 is a sectional side elevational view of a portion of the spout showing the membrane in accordance with a third preferred embodiment of the present invention.
Figure 24:
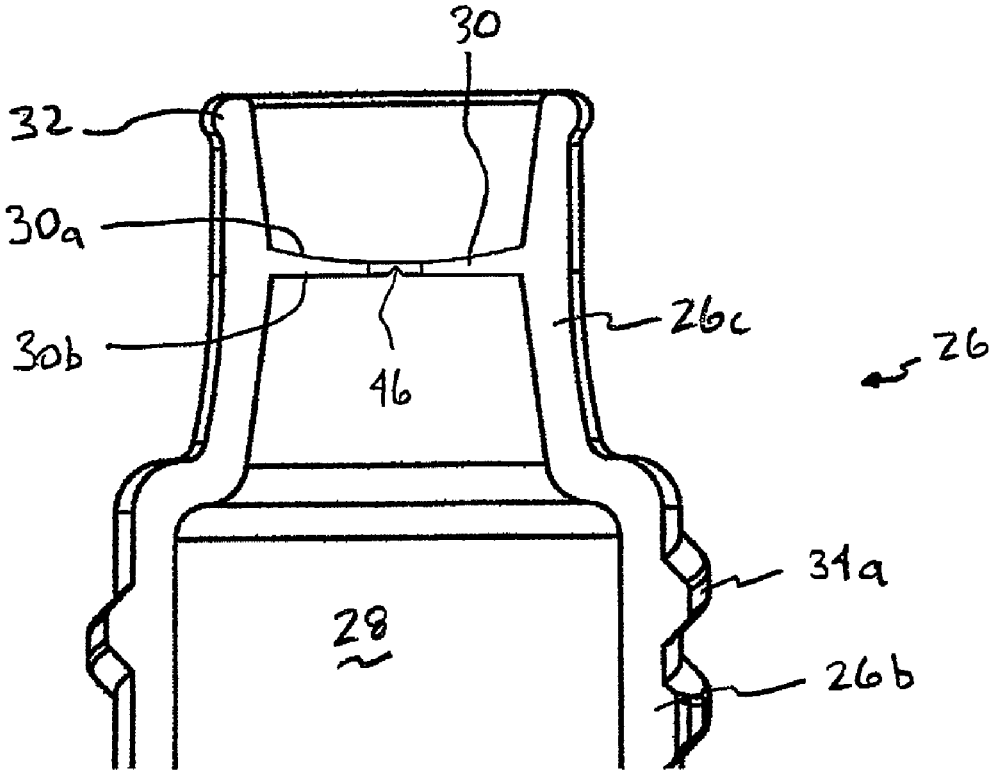
FIG. 24 is a sectional side elevational view of a portion of the spout showing the membrane in accordance with a fourth preferred embodiment of the present invention.

Membrane 30 can be configured in any number of different ways. As show in FIGS. 18-19, membrane 30 can have a constant thickness. However, as shown in FIGS. 22-24, in other embodiments, membrane 30 can have a varying thickness. For example, in FIG. 22, membrane 30 has a top surface 30*a* that is generally concave and a bottom surface 30*b* that is generally concave. In FIG. 23, membrane 30 has a top surface 30*a* that is generally flat and a bottom surface 30*b* that is generally concave. In FIG. 24, membrane 30 has a top surface 30*a* that is generally concave and a bottom surface 30*b* that is generally flat. All such variations are within the scope of the present invention.

Figure 25:
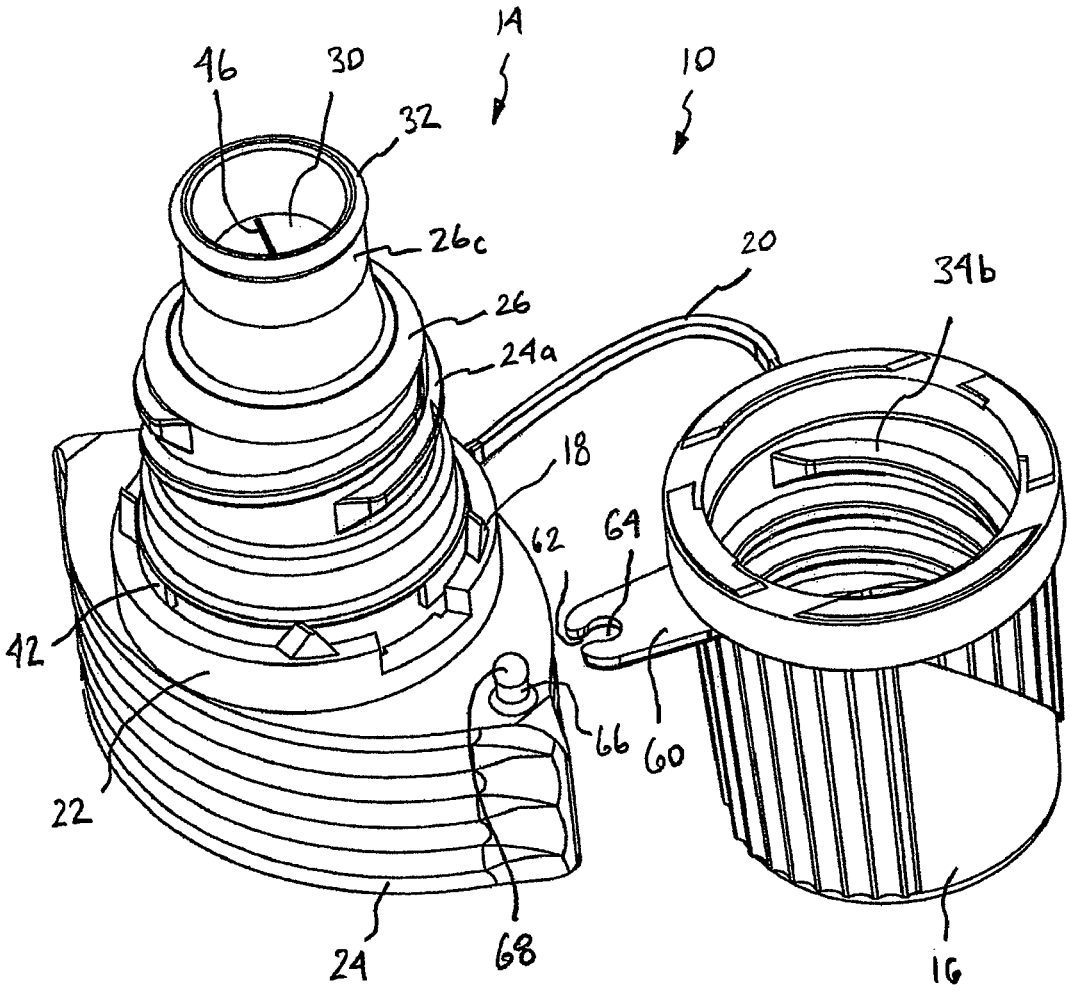
FIG. 25 is a perspective view of the container closure assembly of FIG. 1 with the cap removed from the spout prior to horizontal engagement of the tab with the post.
Figure 26:
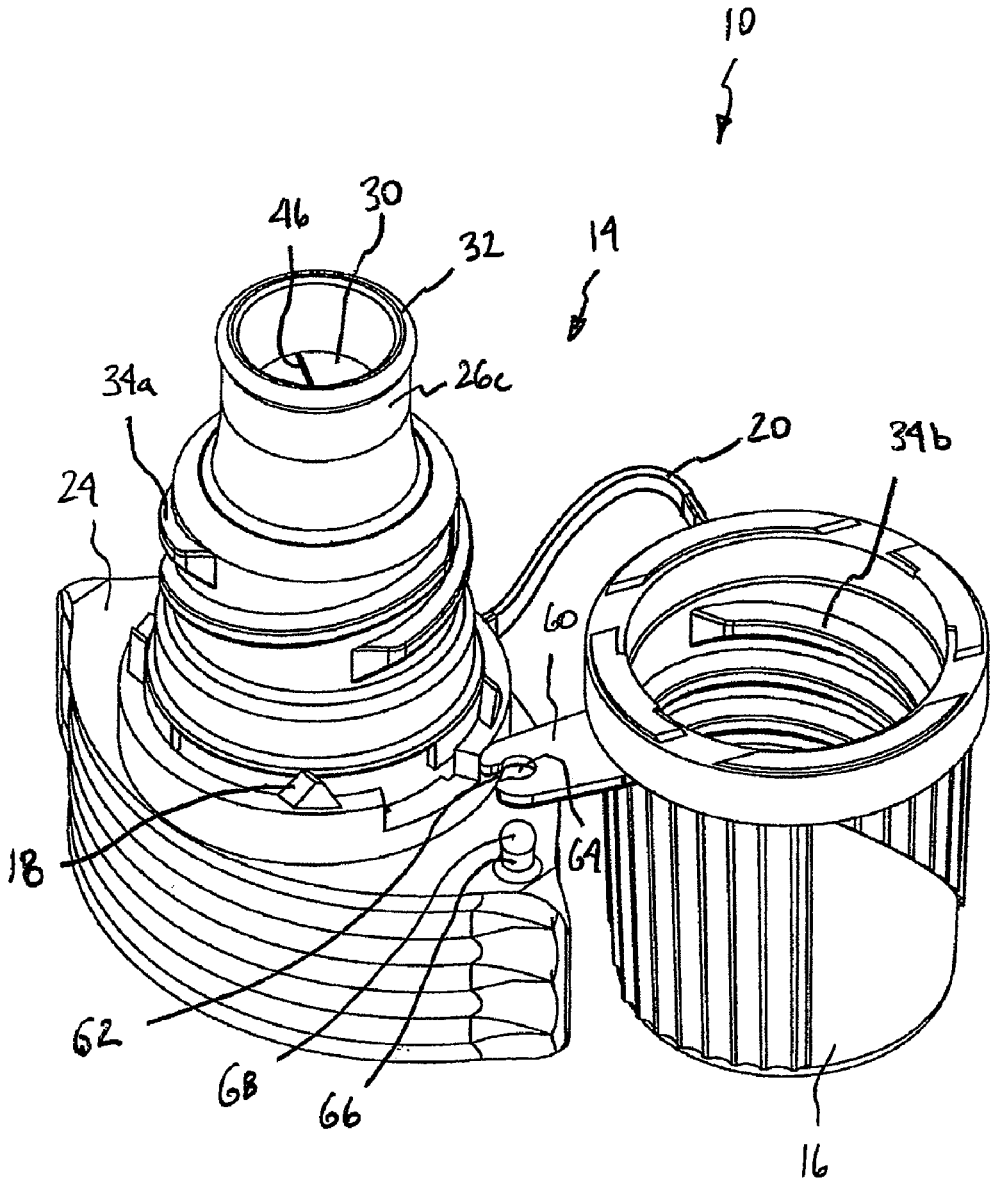
FIG. 26 is a perspective view of the container closure assembly of FIG. 1 with the cap removed from the spout prior to vertical engagement of the tab with the post.
Figure 27:
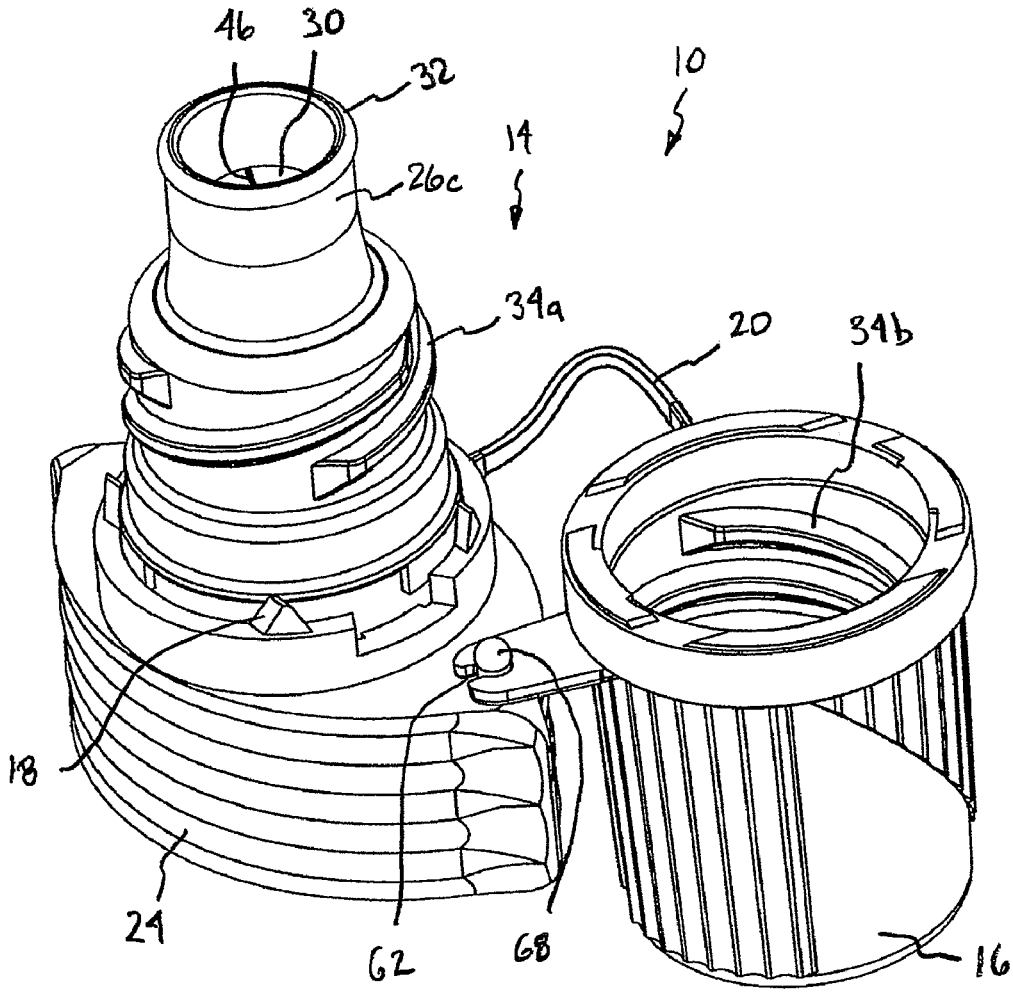
FIG. 27 is a perspective view of the container closure assembly of FIG. 1 with the cap removed from the spout after engagement of the tab with the post.
Figure 28:
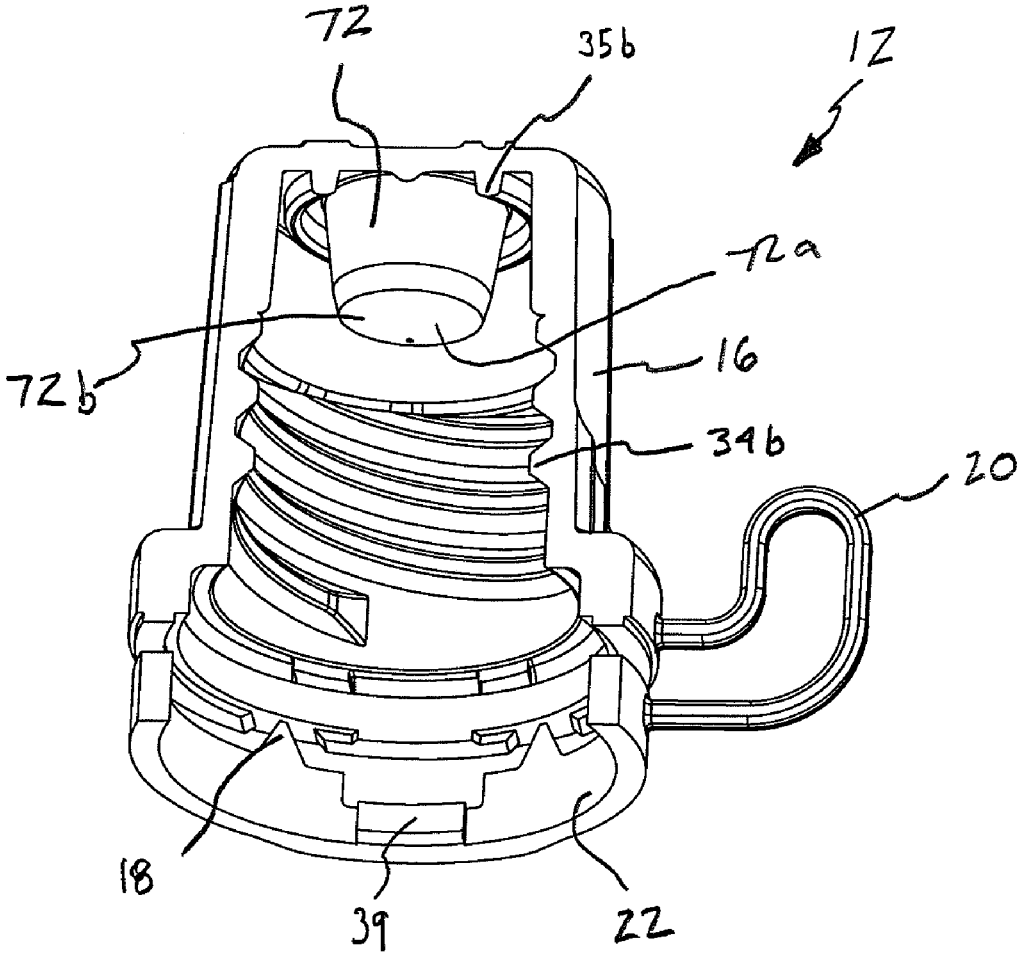
FIG. 28 is a sectional perspective view of a cap member in accordance with another preferred embodiment of the present invention.
Figure 29:
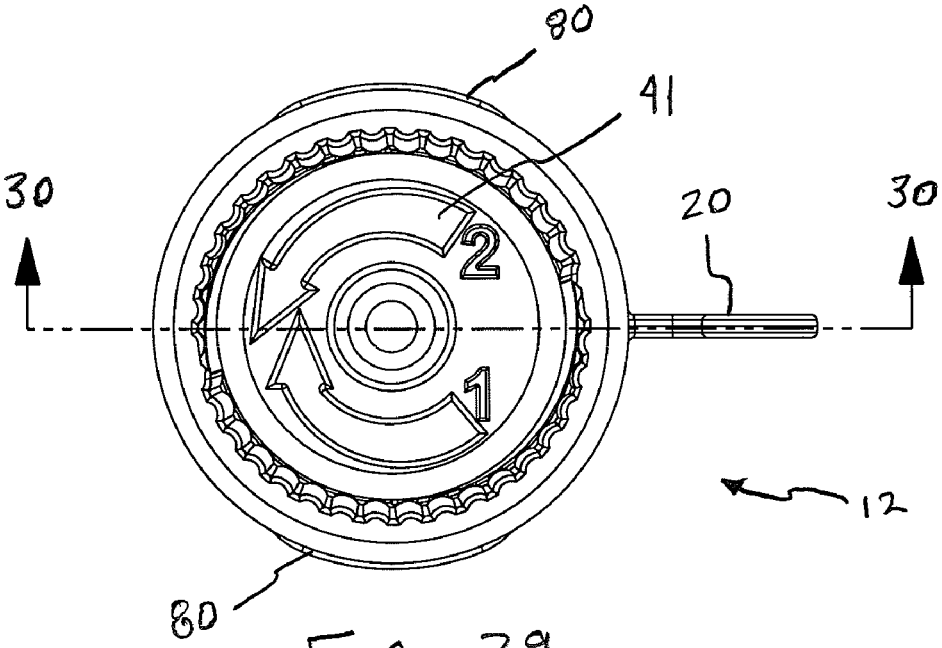
FIG. 29 is a top plan view of the cap member of FIG. 28.

As shown in FIGS. 25-27, in a preferred embodiment, container closure assembly 10 includes the capability of securing the removed cap 16 on sleeve 14. This keeps cap 16 out of the way while drinking. In an exemplary embodiment, the cap includes a tab 60 extending therefrom that has a slot 62 and opening 64 arrangement defined in the distal end thereof. Fitment base 24 includes a post 66 that extends upwardly from its upper surface. Post 66 has a ball 68 formed on its distal end. Opening 64 is sized to receive post 66. Preferably, because of the flexible nature of the materials from which tab 60 and post 66 are made, tab 60 can be secured on or engaged with post 66 either horizontally or vertically.

With reference to FIG. 25, slot 62 has a width that is smaller than the diameter of post 66. Accordingly, to horizontally engage tab 60 with post 66, post 66 is pressed through slot 62 until post 66 comes to rest in opening 64, as is shown in FIG. 27.

With reference to FIG. 26, ball 68 preferably has a diameter that is greater than the diameter of opening 64. Accordingly, to vertically engage tab 60 with post 66, ball 68 is pressed through opening 64 until post 66 comes to rest in opening 64, as is shown in FIG. 27. In an alternative, an opening can defined in leash 20 that can be placed on post 66.

It will be appreciated by those skilled in the art that other methods for temporarily securing cap 16 on sleeve 14 are within the scope of the present invention. For example, snaps, VELCRO™, other press fits (e.g., a post on the cap that is press fit into an opening or depression in the neck), hooks and the like are all within the scope of the present invention.

FIGS. 28-43 show another preferred embodiment of a container closure assembly 70 that includes a piercer or puncturing mechanism 72 that is not as pointed as the piercer 36 described above. FIGS. 28-36*b* show the container closure assembly 70 with a fitment base 24 similar to that described above and FIGS. 37-44 show the container closure assembly with a fitment base that comprises a flange 74 for sealing the container closure assembly 70 to a container 100. As will be appreciated by those skilled in the art, the shape of puncturing mechanism 72 allows for a controlled puncture of membrane 30. Preferably, puncturing mechanism 72 has a generally cylindrical shape (it may include a slight frustoconical shape to it). The shape allows almost the entire puncturing surface (referred to herein as contact cone 72*a* and contact surface 72*b*) to contact membrane 30. As more force is applied membrane 30 will start to deform and then the score lines 46 will tear essentially simultaneously. This is in contrast to piercer 36 described above, where the tip pierces membrane 30 and then slowly opens up the score lines 46 as the piercer 36 moves downwardly.

Puncturing mechanism 72 can be manufactured in two different ways: solid and hollow. For example, in FIG. 48, puncturing mechanism 72 is solid, which is better for aseptic processing because the cap 16 is filled in and the top of the cap 16 is flat; sanitizing solution will easily run off the cap when washing. Moreover, in FIG. 52, puncture mechanism 72 is hollow. This is advantageous because it requires less material and is easier to mold.

Figure 30:
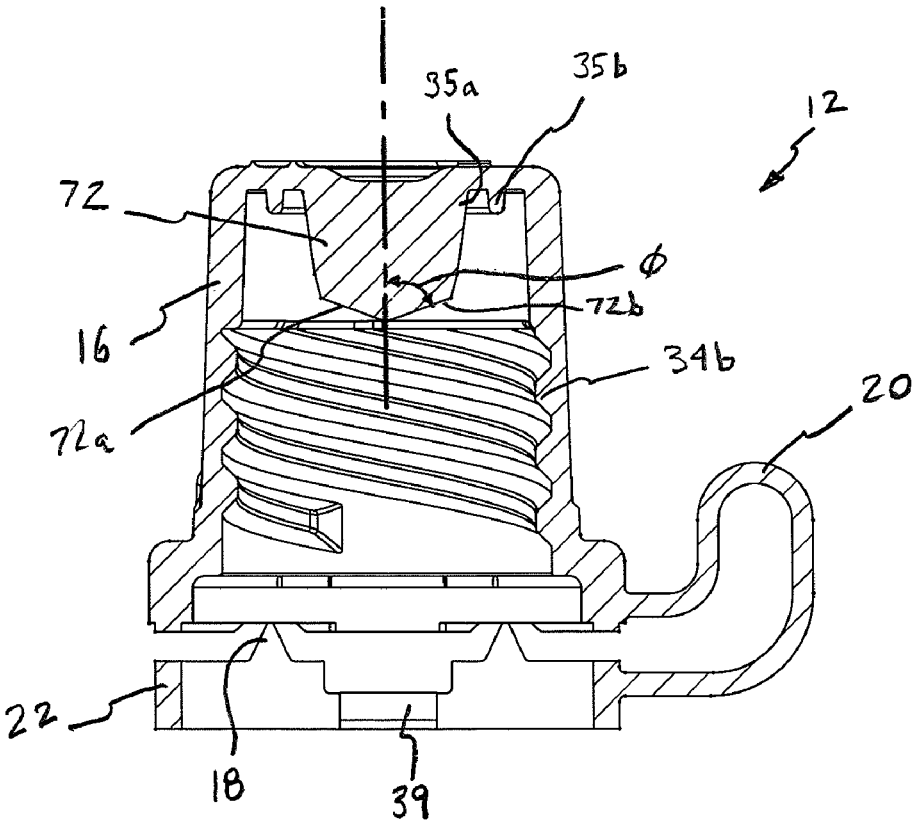
FIG. 30 is a sectional side elevational view of the cap member of FIG. 28 taken along line 30-30 of FIG. 29.
Figure 31A:
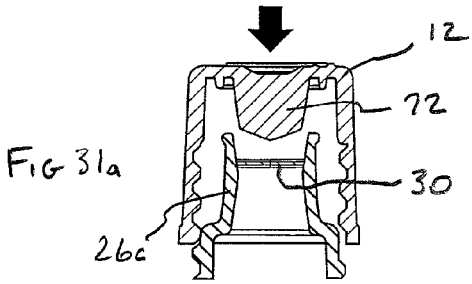
FIGS. 31*a*-31*d* are a series of sectional side elevational views of a cap member and nozzle showing the puncturing mechanism puncturing the membrane when the membrane is located at a first position within the nozzle.
Figure 32A:
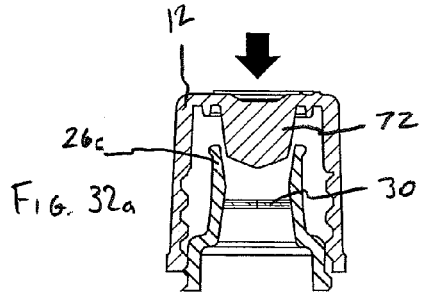
FIGS. 32*a*-32*d* are a series of sectional side elevational views of a cap member and nozzle showing the puncturing mechanism puncturing the membrane when the membrane is located at a second position within the nozzle.
Figure 31B:
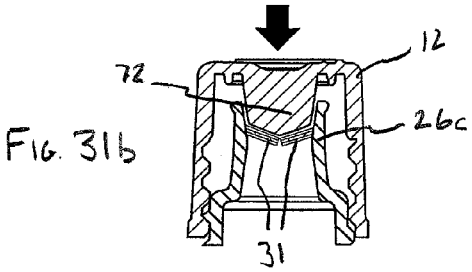
Figure 32B:
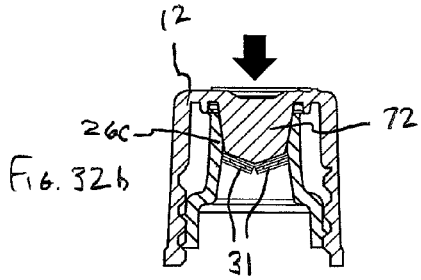
Figure 31C:
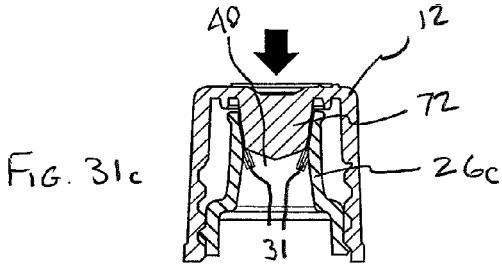
Figure 32C:
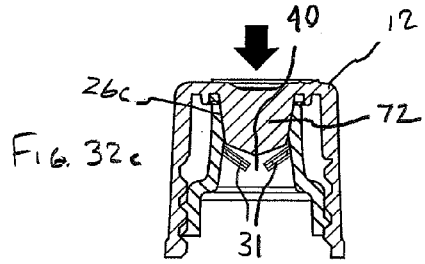
Figure 31D:
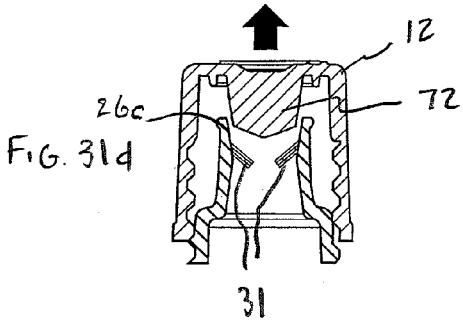
Figure 32D:
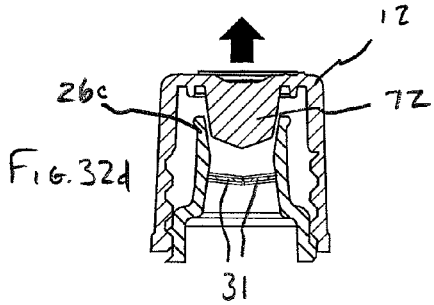
Figure 33A:
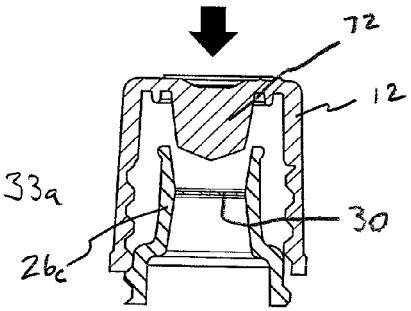
FIGS. 33*a*-33*d* are a series of sectional side elevational views of a cap member and nozzle showing the puncturing mechanism puncturing the membrane when the puncturing mechanism is a first length.
Figure 33B:
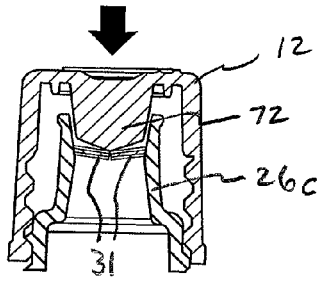
Figure 33C:
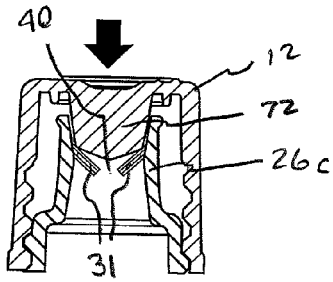
Figure 33D:
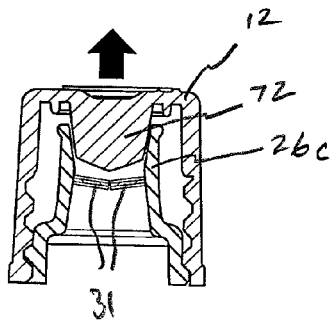
Figure 34A:
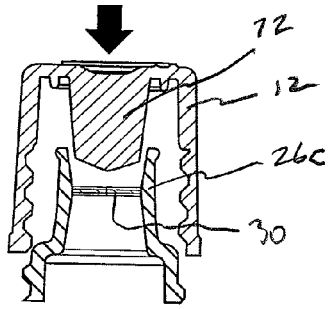
FIGS. 34*a*-34*d* are a series of sectional side elevational views of a cap member and nozzle showing the puncturing mechanism puncturing the membrane when the puncturing mechanism is a second length.
Figure 34B:
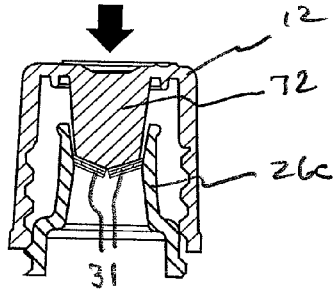
Figure 34C:
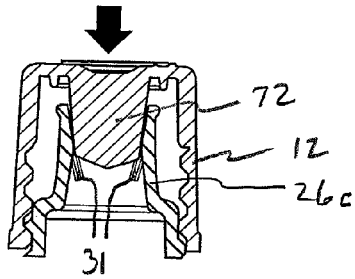
Figure 34D:
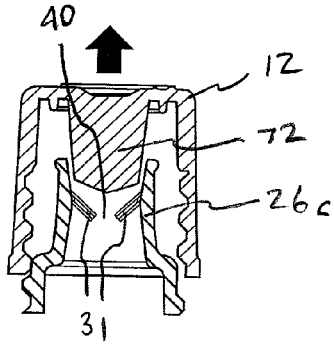

As can be seen in FIG. 30, which shows a vertically cut cross section of cap member 12, contact cone 72*a* includes a contact surface 72*b* that forms an angle θ with the vertical axis of puncturing mechanism 72. In a preferred embodiment θ is between about 40 degrees and about 89 degrees. In a more preferred embodiment θ is between about 65 degrees and about 75 degrees and in the most preferred embodiment θ is about 70 degrees. It will be understood that these angles allow the contact cone 72*a* as a whole to comprise a preferably obtuse angle that actually contacts membrane 30. This shape of contact cone 72*a* allows a large surface area to contact membrane 30 as it is pressed downwardly to be punctured. This allows score lines 46 to break and helps the flaps 31 retain their memory, thus creating the flow control or check valve, as described more fully below. In a preferred embodiment, contact cone 72*a* contacts between 20% and 70% of the surface area of the upper surface of membrane 30. It will be understood that the area of membrane 30 that will come in contact with the puncturing mechanism 72 depends on the length of the puncturing mechanism and/or the vertical placement of the membrane 30. The more puncturing mechanism 72 travels downward, the more of membrane 30 it contacts, this is because, in a preferred embodiment, it is angled and grows wider as it travels downward.

In a preferred embodiment, puncturing mechanism 72 first hits membrane 30 at the point of contact cone 72*a* and then hits at least 50% of membrane 30, and then, possibly as much as 90% after full travel downward of the standard length puncturing mechanism 72 (described below).

It should be understood that in this embodiment, sealing ring 35*a* is unitary with or a part of puncturing mechanism 72. As described above, membrane 30 preferably acts as a flow control mechanism. As shown in FIGS. 31*a*-34*d*, two different ways to control the puncture of membrane 30 are vertical placement of membrane 30 within nozzle 26*c* and the length of puncturing mechanism 72. FIGS. 31*a*-31*d* and FIGS. 32*a*-32*d* show membrane 30 in two different positions within nozzle 26*c*.

In FIGS. 31*a*-31*d*, membrane 30 is located in a first or upper position in the nozzle 26*c*. As shown, in this position, puncturing mechanism 72 contacts membrane 30 earlier than it does in the position shown in FIGS. 32*a*-32*d*. As a result, puncturing mechanism 72 tears the score lines 46 almost completely and biases the flaps 31 downwardly (see FIG. 31*c*). As a result, after puncturing mechanism 72 is pulled back away from the torn membrane 30, the flaps 31 have been stretched and stressed enough that they do not go back to their original shape (see FIG. 31*d*). This allows liquid to flow freely through the resulting opening 40.

In FIGS. 32*a*-32*d*, membrane 30 is located in a second or lower position in nozzle 26*c*. As shown, in this position, puncturing mechanism 72 contacts membrane 30 later than it does in the position shown in FIGS. 31*a*-31*d*. As a result, puncturing mechanism 72 does not place as much force on membrane 30 and only tears the score lines 46 slightly and does not bias the flaps 31 downwardly very much (see FIG. 32*c*). As a result, after puncturing mechanism 72 is pulled back away from the torn membrane 30, the memory of the material that comprises the flaps 31 causes the flaps to retain or almost retain their original shape (see FIG. 32*d*). At this point, the opening is essentially gone and there are only slits where the former score lines 46 existed. This essentially creates a check valve and prevents fluid from flowing freely through the slits without positive or negative pressure (as discussed above) exerted on the container. It will be understood that the first and second membrane positions shown in the figures are only exemplary, and that membrane 30 can be positioned at any point along the length of nozzle 26*c*. In a preferred embodiment the flaps 31 are wedge shaped, however this is not a limitation on the invention. It will be understood that the flaps' shape is determined by the score lines 46.

FIGS. 33*a*-33*d* and FIGS. 34*a*-34*d* show two different length puncturing mechanisms 72 (short and standard). For example, in a preferred embodiment, the standard length of puncturing mechanism 72 is about 0.265", and the shorter length is about 0.235". However, these lengths are not a limitation on the present invention.

In FIGS. 33*a*-33*d*, puncturing mechanism 72 is shorter. As shown, in this position, puncturing mechanism 72 contacts membrane 30 later than it does in the position shown in FIGS. 34*a*-34*d*. As a result, puncturing mechanism 72 does not place as much force on membrane 30 and only tears the score lines 46 slightly and does not bias the flaps 31 downwardly very much (see FIG. 33*c*). As a result, after the shorter puncturing mechanism 72 is pulled back away from the torn membrane 30, the memory of the material that comprises the flaps 31 causes the flaps to retain or almost retain their original shape (see FIG. 33*d*). At this point, the opening is essentially gone and there are only slits where the former score lines 46 existed. This essentially creates a check valve, just like the lower positioned membrane 30 described above.

In FIGS. 34*a*-34*d*, puncturing mechanism 72 is longer or standard length. As shown, in this position, because of its length, puncturing mechanism 72 contacts membrane 30 earlier than it does in the position shown in FIGS. 33*a*-33*d*. As a result, puncturing mechanism 72 tears the score lines 46 almost completely and biases the flaps 31 downwardly (see FIG. 33*c*). As a result, after puncturing mechanism 72 is pulled back away from the torn membrane 30, the flaps 31 have been stretched and stressed enough that they do not go back to their original shape (see FIG. 33*d*) This allows liquid to flow freely through the resulting opening 40, similar to the upper positioned membrane 30 described above. It will be understood that the length of puncturing mechanisms 72 shown in the figures are only exemplary, and that puncturing mechanism 72 can be any desired length.

Figure 36A:
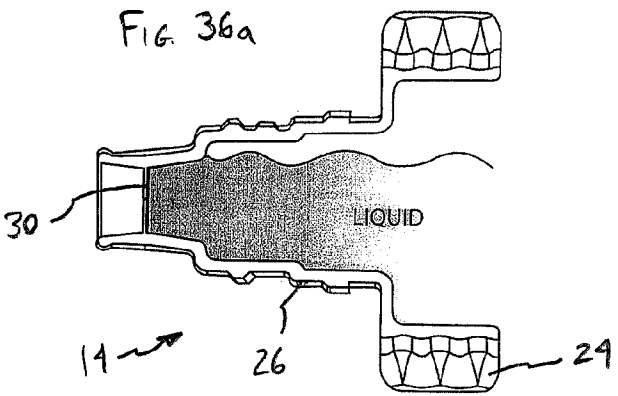
FIG. 36*a*-36*b* are a series of sectional side elevational views of a sleeve filled with liquid and showing how the punctured membrane can act as a flow control valve.
Figure 36B:
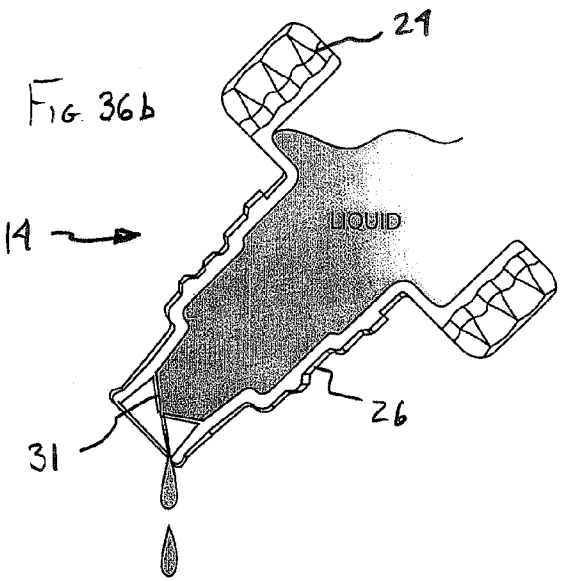
Figure 35A:
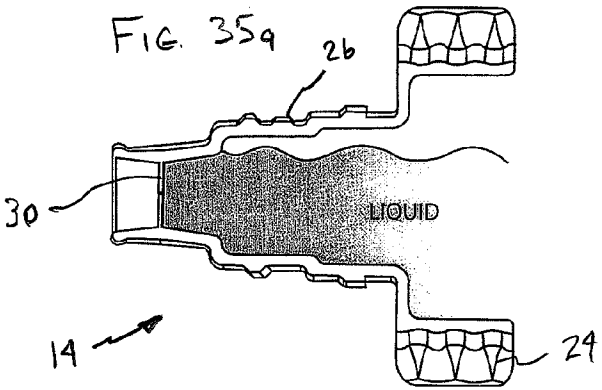
FIG. 35*a*-35*b* are a series of sectional side elevational views of a sleeve filled with liquid and showing how the punctured membrane can act as a flow control valve.
Figure 35B:
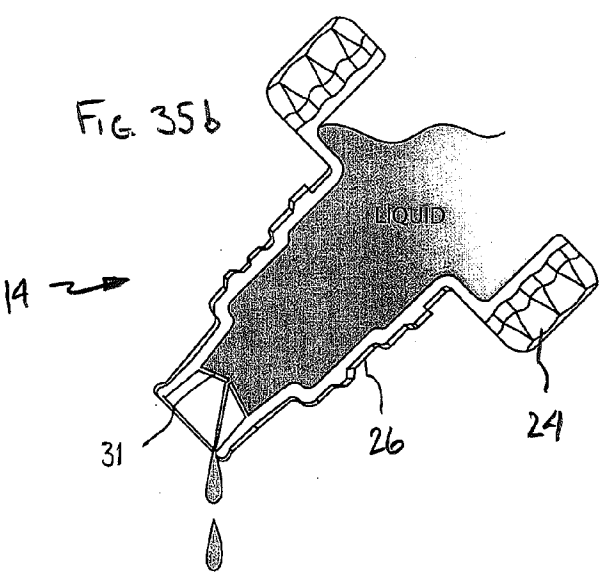

FIGS. 35*a*-36*b* show an example of how a punctured membrane works to control flow (a check valve) when the membrane has been punctured, for example, as shown in FIGS. 32*a*-32*d* and 33*a*-33*d*. As can be seen in FIGS. 35*a* and 36*a*, when the container and sleeve are held horizontally the membrane prevents liquid from flowing through the opening. And, when the container and sleeve are tilted passed horizontal, only a small amount of liquid gets through the opening. FIGS. 35*a*-35*b* show the membrane 30 when it is made of a material such as high density polyethylene or polypropylene of various melt rates, and FIGS. 36*a*-36*b* show the membrane 30 when it is made of a material such as medical grade silicon.

Figure 37:
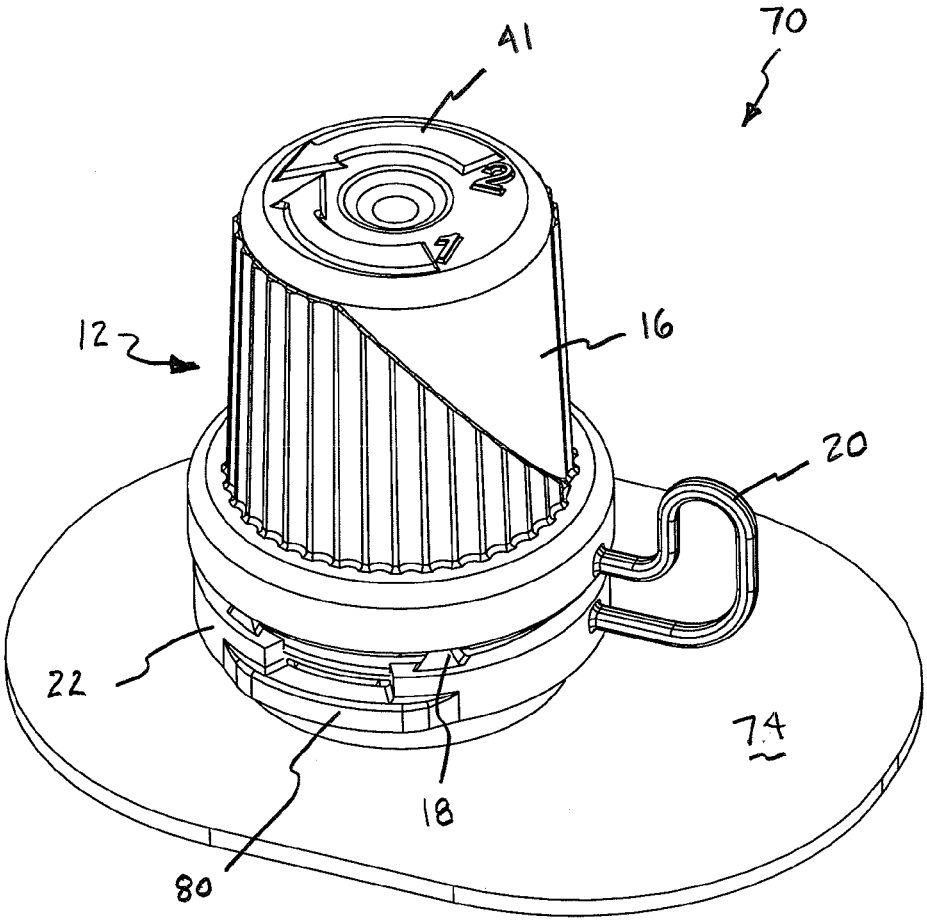
FIG. 37 is a perspective view of a container closure assembly with the cap member on the sleeve in accordance with another preferred embodiment of the present invention.
Figure 38:
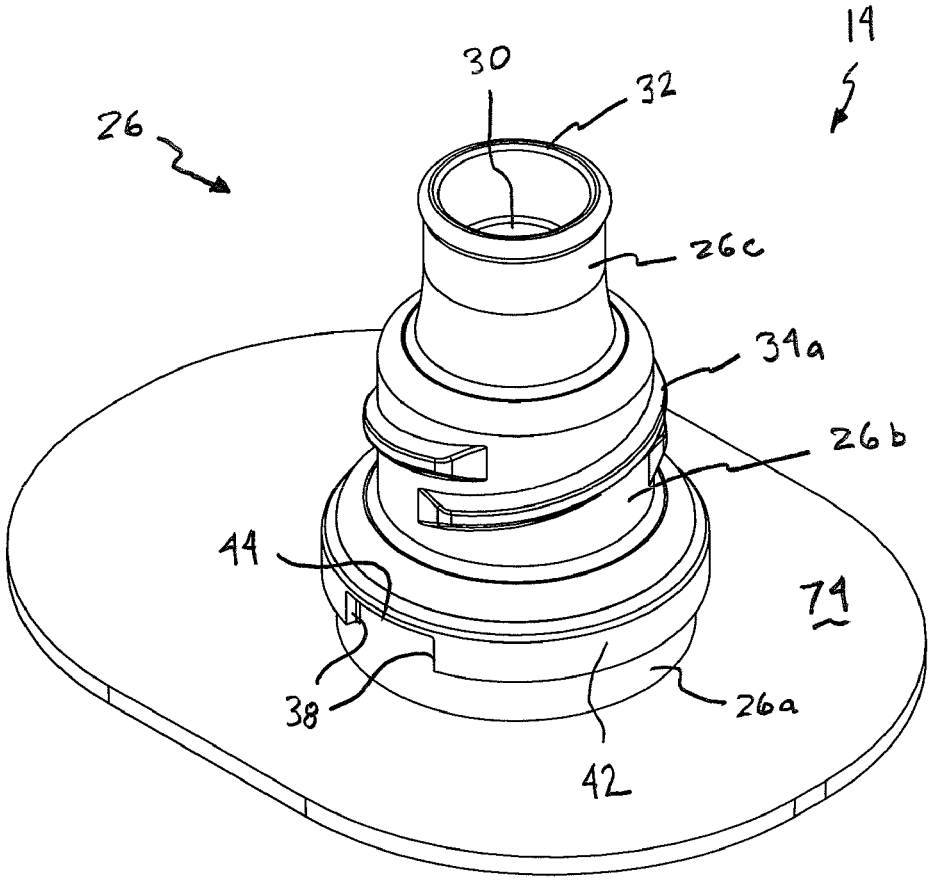
FIG. 38 is a perspective view of the sleeve of FIG. 37.
Figure 39:
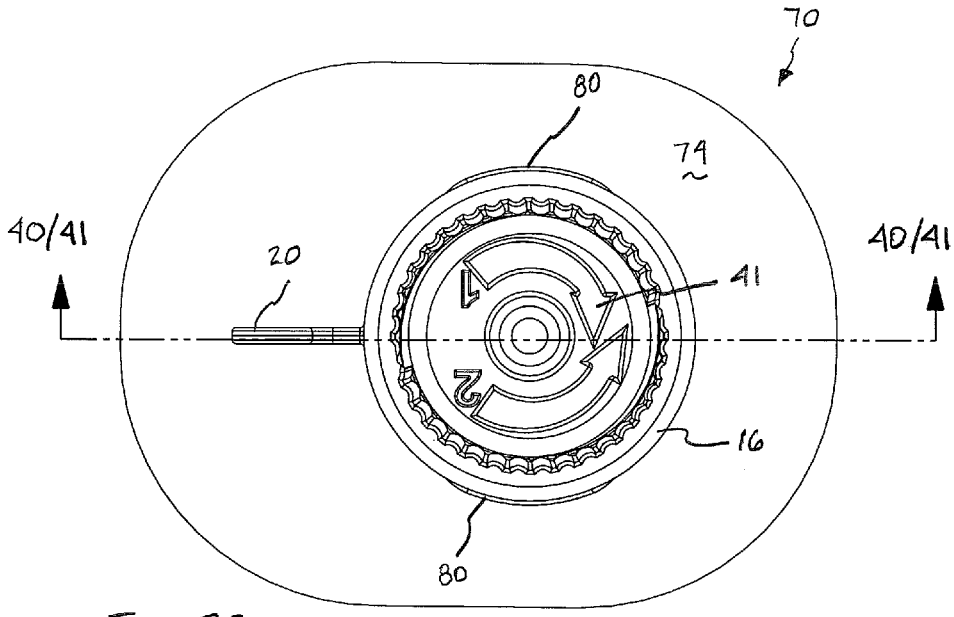
FIG. 39 is a top plan view of the container closure assembly of FIG. 37.
Figure 40:
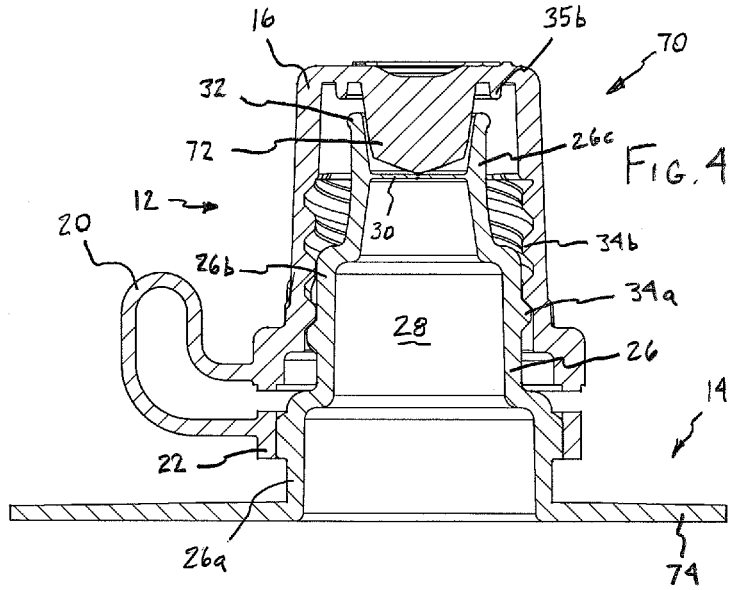
FIG. 40 is a sectional side elevational view of the container closure assembly of FIG. 37 taken along line 40/41-40/41 of FIG. 39 showing a long puncturing mechanism.
Figure 41:
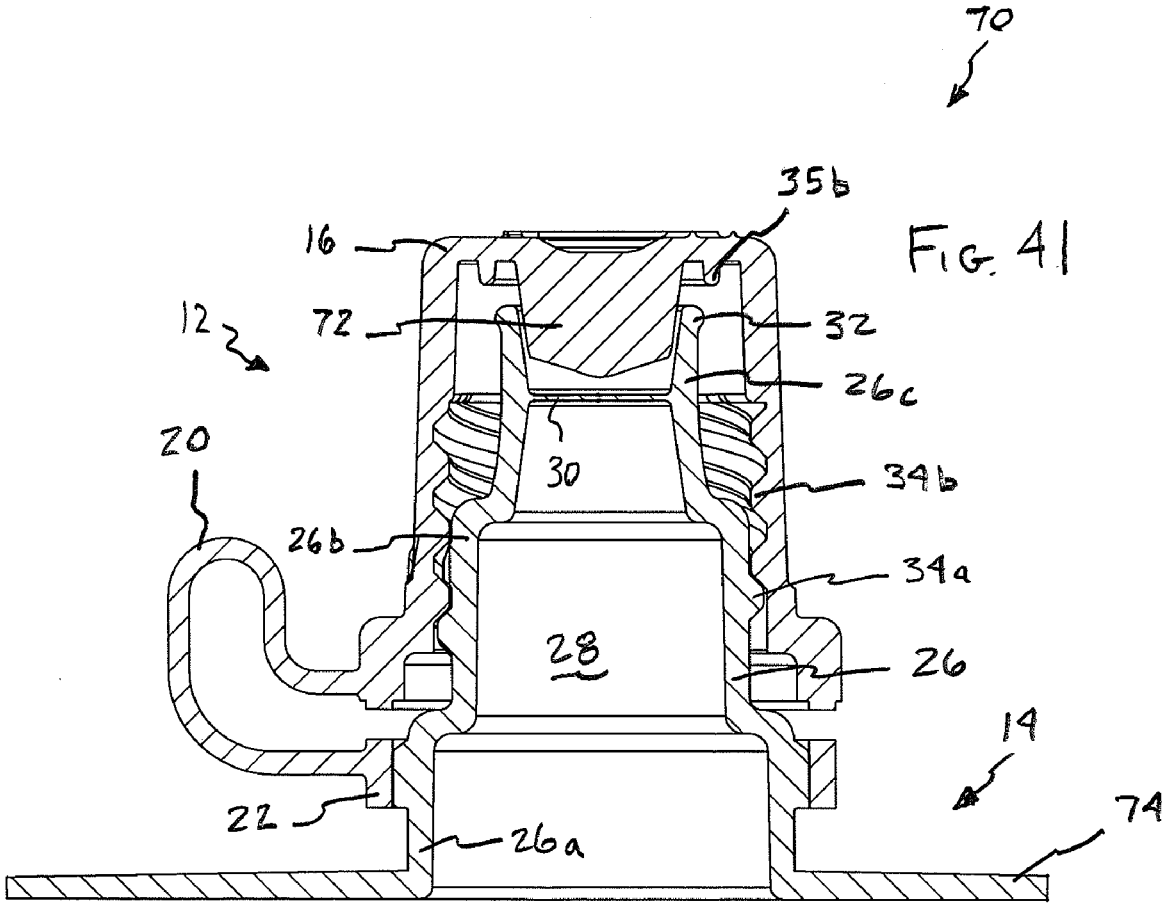
FIG. 41 is a sectional side elevational view of the container closure assembly of FIG. 37 taken along line 40/41-40/41 of FIG. 39 showing a short puncturing mechanism.

As is shown in FIG. 37, in a preferred embodiment, ring 22 can include a rib 80 on its outside surface at a location adjacent to where tooth 39 is on the inside of ring 22. This helps strengthen this portion of ring 22 (which is thinner than the remainder of ring 22) and prevent it from breaking either during assembly, when cap member 12 is pushed onto sleeve 14, or during use.

Figure 42:
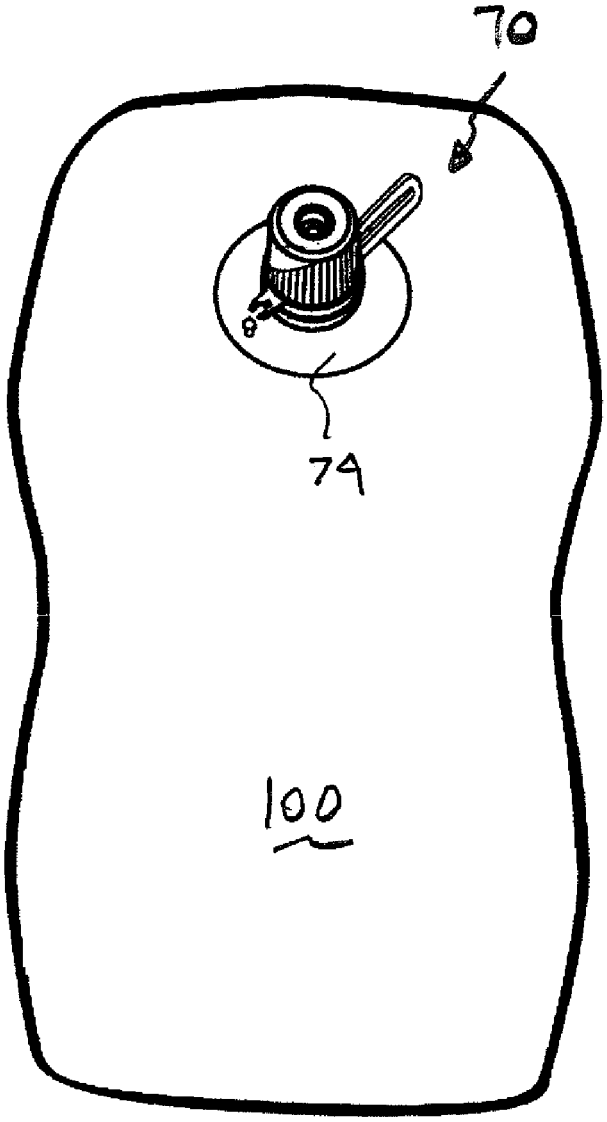
FIG. 42 is a side elevational view of a container with a container closure assembly thereon, where the flange is attached to the outside of the container.
Figure 43:
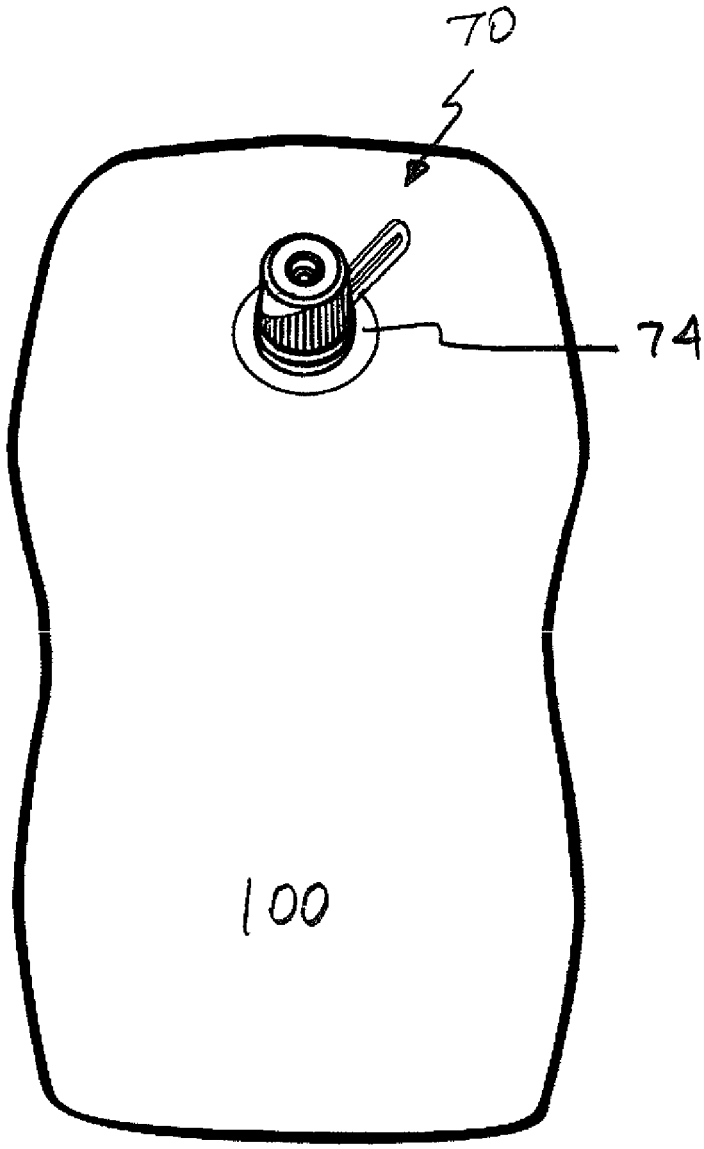
FIG. 43 is a side elevational view of a container with a container closure assembly thereon, where the flange is attached to or sealed to the inside of the container.

As shown in FIGS. 42-43, flange 70 can be sealed to either the outside (FIG. 42) or the inside (FIG. 43) of a container 100. Similar sealing mechanisms to those described above with respect to fitment base 24 can be used. In a preferred embodiment, flange 70 includes grooves or ridges thereon to help with the seal between flange 70 and container 100.

Figure 44:
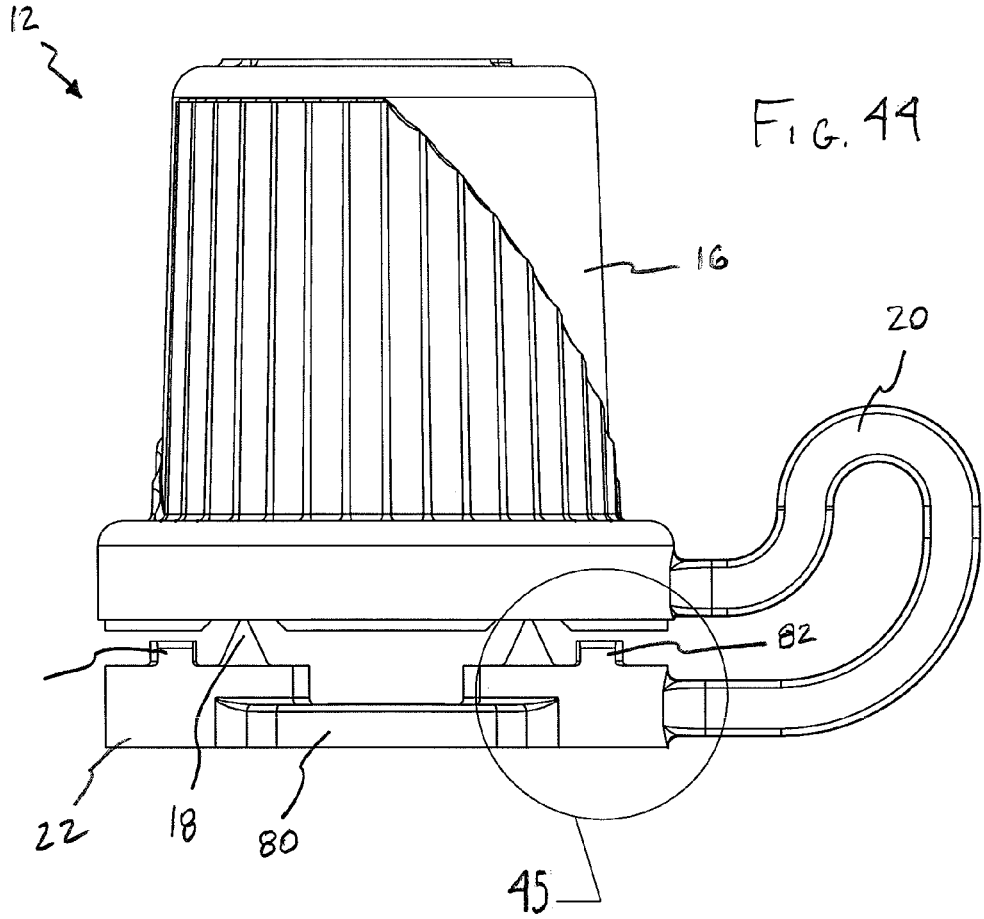
FIG. 44 is a side elevational view of a cap member having a bumper thereon.
Figure 45:
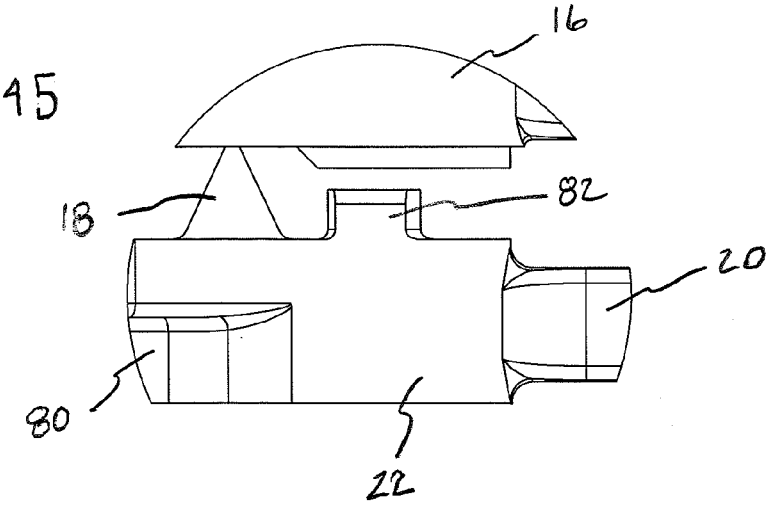
FIG. 45 is a detailed view of the bumper of FIG. 44.
Figure 46:
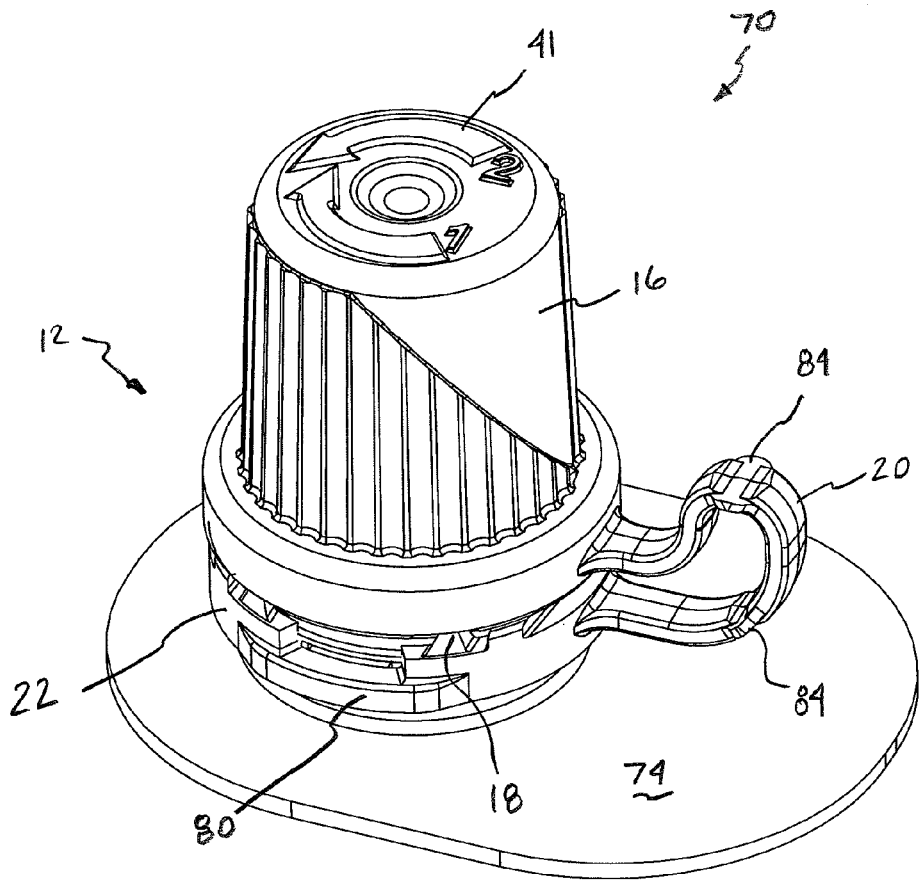
FIG. 46 is a perspective view of a container closure assembly with the cap member on the sleeve where the leash includes hinges in accordance with another preferred embodiment of the present invention.

FIGS. 44 and 45 show ring 22 with a bumper 82 or bumpers thereon. In a preferred embodiment, when initially assembling the container closure assembly 10 or 70, to place cap member 12 on sleeve 14, the loose cap member 12 is placed onto spout 26 and cap member 12 is pushed downwardly and snapped into place. In this embodiment, the components are made of a material that allows threads 34*b* and ring 22 to stretch slightly as they ride over threads 34*a* and protrusive ring 42 as cap member 12 is pressed into place. Tear tabs 18 are constructed so that they tear easily when turned by a user. To prevent the tear tabs 18 from breaking when cap member 12 is pressed into place, bumpers 82 are provided to prevent ring 22 from traveling too far upwardly. This effectively reduces the gap between ring 22 and cap 16. Therefore, as cap member 12 is pressed into place, cap 16 moves downwardly and contacts the top of bumpers 82, which helps provide pressure on ring 22 so that it will snap over protrusive ring 42.

Figure 47:
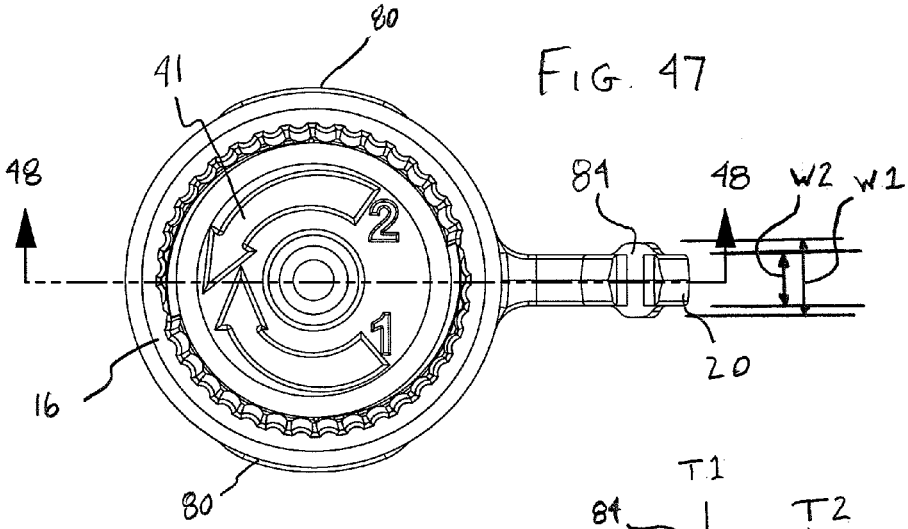
FIG. 47 is a top plan view of the cap member of FIG. 46.
Figure 48A:
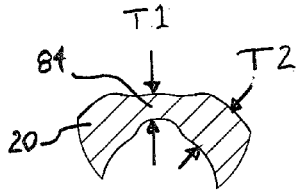
FIG. 48*a* is a detailed view taken from the circle marked 48*a* in FIG. 48.
Figure 48:
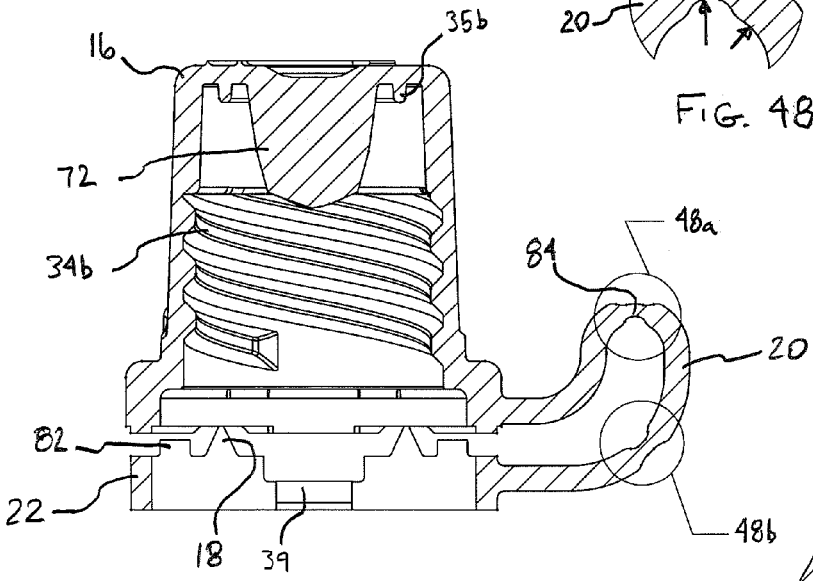
FIG. 48 is a sectional side elevational view of the cap member of FIG. 46 taken along line 48-48 of FIG. 47.
Figure 48B:
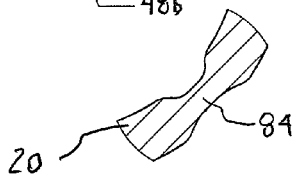
FIG. 48*b* is a detailed view taken from the circle marked 48*b* in FIG. 48.
Figure 49:
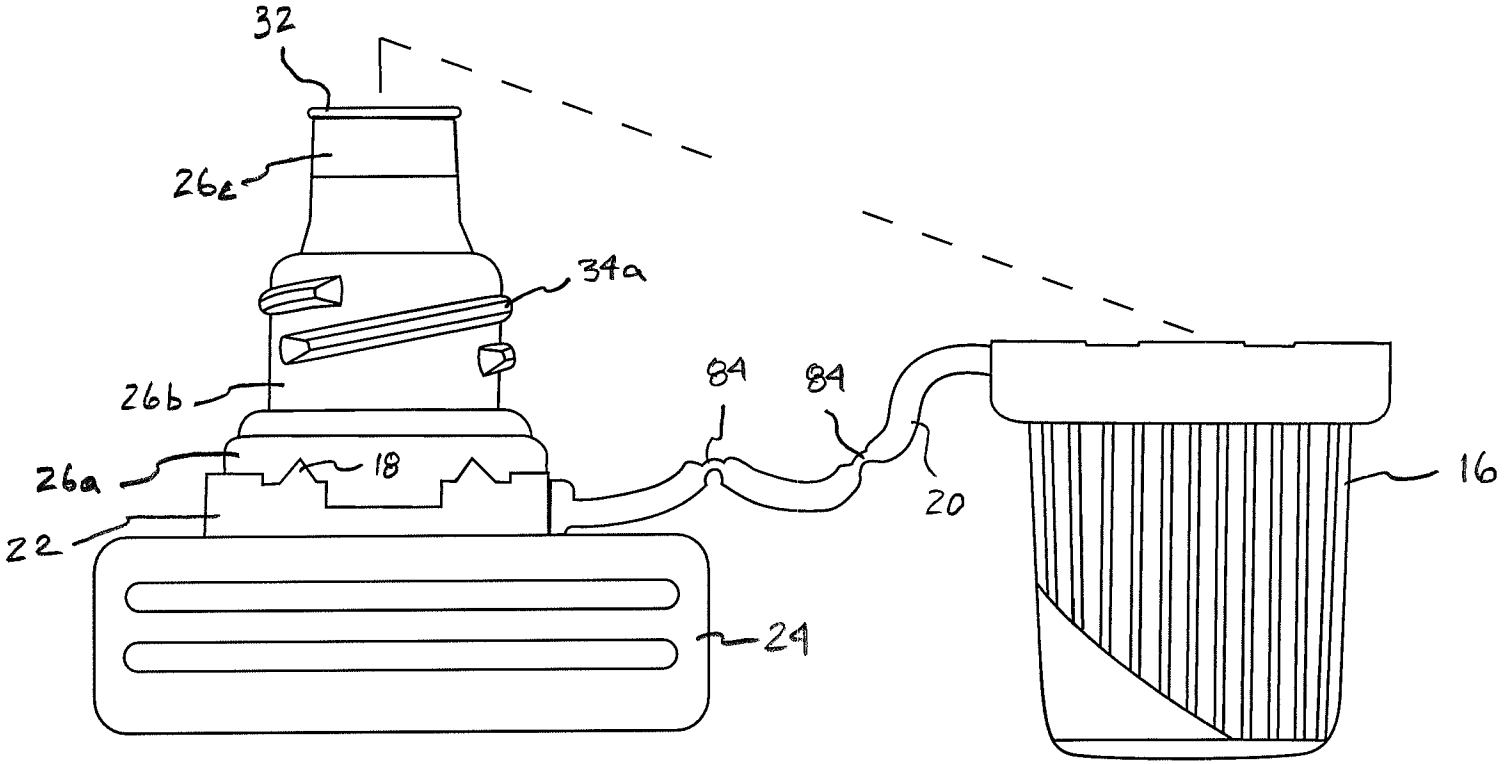
FIG. 49 is a side elevation view of the cap member and sleeve of FIG. 46 with the cap removed to show the action of the hinges.
Figure 50:
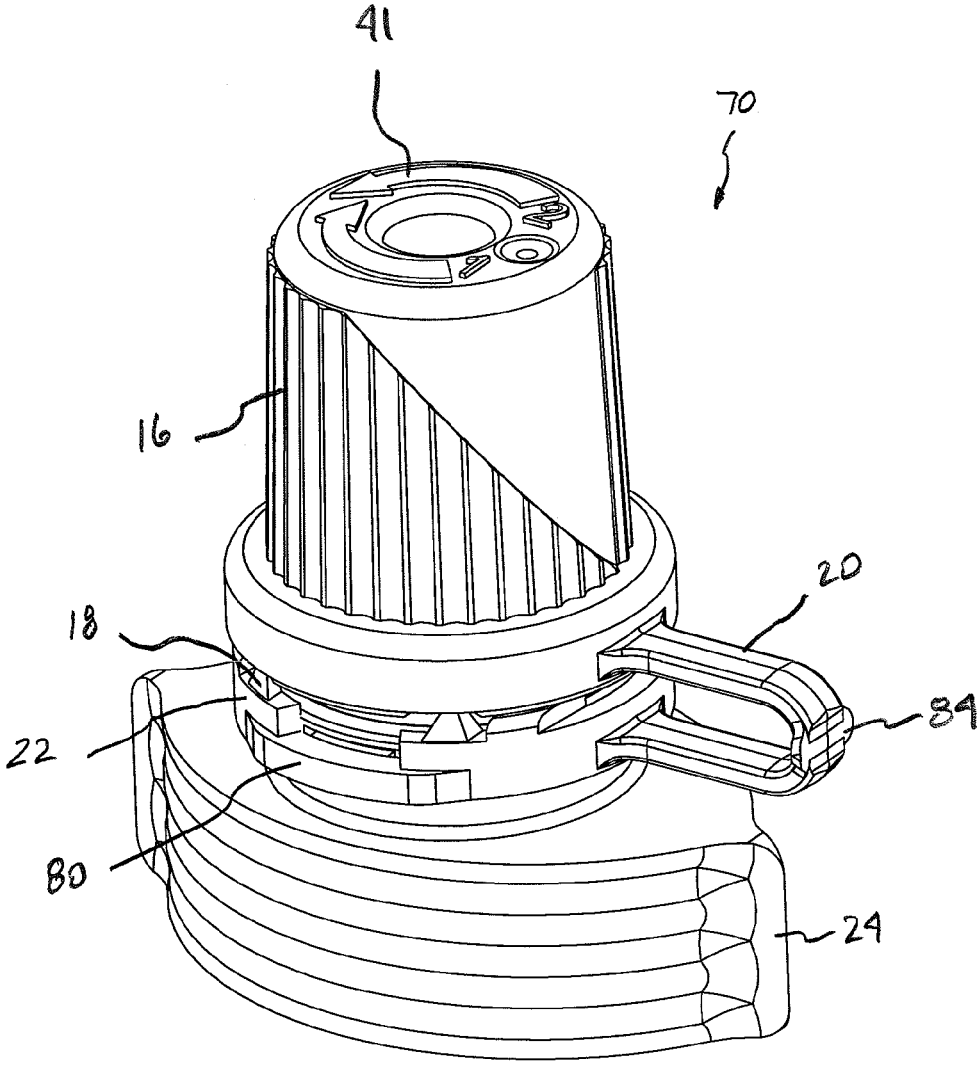
FIG. 50 is a perspective view of a container closure assembly with the cap member on the sleeve where the leash includes a hinge in accordance with another preferred embodiment of the present invention.
Figure 53:
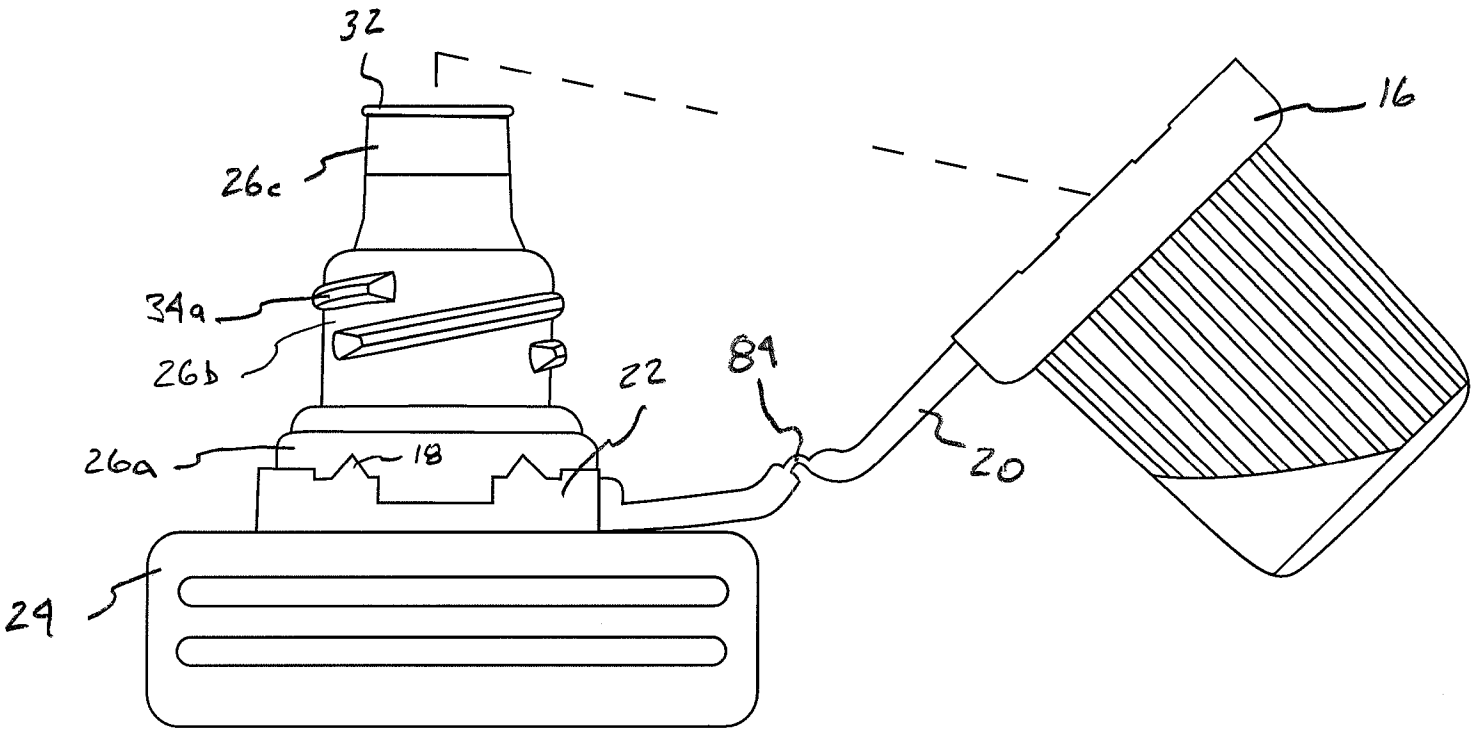
FIG. 53 is a side elevation view of the cap member and sleeve of FIG. 50 with the cap removed to show the action of the hinge.

FIGS. 46-53 show another preferred embodiment that includes hinges 84 on the leash 20. After the cap 16 has been removed from the spout 26 it is preferable to keep the cap 16 out of the way to make drinking from the spout 26 easier. However, at the same time, the leash 20 keeps the cap 16 connected to the ring 22 to prevent the cap 16 from being lost and becoming a potential choking hazard. Accordingly, the hinge(s) 84 on the leash are one way to keep the cap 16 away from the spout 26, while keeping the cap 16 attached to the ring 22, as shown in FIGS. 49 and 53. As can be seen, FIGS. 46-49 show a leash 20 with two hinges 84 and FIGS. 50-53 show a leash 20 with a single hinge 84. Any number of hinges 84 are within the scope of the present invention.

In a preferred embodiment, the hinges 84 comprise a section of thinner material or reduced cross-section than the remainder of the leash 20. As shown in FIG. 48*a*, hinge 84 has a thickness T1 that is less than that of leash 20, which has a thickness T2. In a more preferred embodiment, the hinge 84 comprises a section of thinner material, but also is wider than the remainder of the leash. As is shown in FIG. 47, hinge 84 has a width W1 that is greater than that of leash 20, which has a width W2. The thinner section allows the leash 20 to bend at that point, and the wider section maintains a higher tension strength and helps prevent the leash from failing at the hinge after repeated stressing.

In a preferred embodiment, leash 20 is long enough to allow cap 16 to be twisted in both directions (for puncturing and removing). In particular, this applies to the leash 20 with the dual hinge (FIG. 53), looped configuration. It is easier to twist due to the long leash length, extra break in the thickness of plastic (at hinge 84) and that at the loop area, the leash travels on a vertical plane, allowing for easier twisting on a horizontal axis.

This is advantageous because cap 16 has to be twisted on an angled (mostly horizontal) axis to puncture the membrane and then on the same axis in the other direction to remove cap 16 from the spout.

It will be appreciated that after the container closure assembly is welded in place to the container 100, the preferable result is a unitary package with no loose parts and no need for straws. The present invention can be used with cold fill, hot fill, aseptic, carbonated, alcohol and dairy filling conditions, among others. It will be appreciated that the present invention provides a high quality airtight seal due to the hermetic quality of the membrane, but the cap is easy to twist on and off due to the lack of airtight seal between the circumference at the top of the spout and the inner surface of the cap.

In another preferred embodiment, the cap is easy to twist off because higher torque is necessary to unscrew the cap than to screw it on. Typically, screw caps need to be tightened and screwed down with high torque so that an airtight seal is maintained against varying environmental conditions, such as change in pressure due to liquid cooling, altitude, changes in temperature, etc. They can only be unscrewed with more torque than required to screw down. If the opposite were true, caps would be easier to unscrew but would also be subject to loosening by natural movement and changes in pressure inside the bottle. This would jeopardize the airtight seal between the inner surface of the cap and top rim of the bottle opening, resulting in a loss of the airtight closure.

In the present invention, the airtight (and preferably hermetic) closure is obtained by the membrane so no airtight seal between the cap and spout opening is necessary. Therefore, no consideration of torque is necessary. The only torque required on the inventive cap is that which is necessary to break the tamper evident connections between the bottom ring and the bottom portion of the cap. This is preferably much less than is typically necessary to break an airtight seal between cap and bottle opening.

Furthermore, with hot fill bottled products, additional torque to unscrew the cap is required because a vacuum is created inside the bottle by the contracting liquid and airspace inside the container. This "pulls" on the cap, creating greater unscrew torque necessary to defeat not only the normal force to unscrew but also the negative pressure.

This also explains the necessity for liners (i.e. compression molded liners) on the inside of caps which help to maintain the airtight seal in the face of changing environmental conditions.

These liners are not necessary in the present invention. Although, they could be used for after the membrane is punctured.

The foregoing embodiments are merely examples of the present invention. Those skilled in the art may make numerous uses of, and departures from, such embodiments without departing from the spirit and the scope of the present invention. Accordingly, the scope of the present invention is not to be limited to or defined by such embodiments in any way, but rather, is defined solely by the following claims.

What is claimed is:

1. A method of dispensing a fluid from a container, the method comprising the steps of:

a. providing a container having a container closure assembly associated therewith, wherein the container closure assembly includes a cap and a spout, wherein the interior of the spout is spanned by a sealed membrane that includes a plurality of score lines defined therein, wherein the cap includes a puncturing mechanism that extends downwardly from the top thereof, b. moving the cap downwardly, c. puncturing the membrane with the puncturing mechanism to break the score lines, thereby forming a plurality of flaps that define an opening, d. removing the cap from the spout, wherein after the cap is removed the material of the membrane causes the membrane to approximately retain its shape from before the membrane was punctured to restrict fluid flow through the opening, and e. dispensing the fluid through the opening.

2. The method of claim 1 wherein the puncturing mechanism is generally cylindrical, defines a vertical axis and includes an end that comprises a contact cone having a contact surface, wherein the contact surface forms an angle of between about 40 degrees and 89 about degrees with the vertical axis.

3. The method of claim 1 wherein the puncturing mechanism is generally cylindrical, defines a vertical axis and includes an end that comprises a contact cone having a contact surface, wherein the contact surface forms an angle of between about 65 degrees and 75 about degrees with the vertical axis.

4. The method of claim 1, wherein the spout includes a lip and the cap includes a sealing ring, and wherein the method further includes the step of placing the cap back on the spout and receiving the lip between the sealing ring and the puncturing mechanism, thereby sealing the container.

5. A container closure assembly comprising:

a. a base that is adapted to be connected to a container, b. a spout extending upwardly from the base, wherein the spout defines an interior and includes a nozzle, the interior of which is spanned by a membrane that includes at least one score line defined therein, c. a cap removably secured on the spout, wherein the cap includes a ring depending from and frangibly connected thereto, and wherein the cap includes a puncturing mechanism depending downwardly from a top thereof, wherein rotation of the cap in a first direction breaks the frangible connection between the cap and ring and causes the puncturing mechanism to puncture the membrane.

6. The container closure assembly of claim 5 wherein the membrane includes a pair of intersecting score lines that tear when the membrane is punctured, wherein the torn membrane comprises a plurality of flaps.

7. The container closure assembly of claim 5 further comprising a leash having a first end connected to the cap and a second end connected to the ring.

8. The container closure assembly of claim 7 wherein the leash includes at least one hinge thereon.

9. The container closure assembly of claim 8 wherein the leash has a thickness and a width and the hinge comprises a portion of the leash that has a thinner thickness than the remainder of the leash, thereby allowing the leash to bend at the hinge.

10. The container closure assembly of claim 9 wherein the hinge also has a wider width than the remainder of the leash.

11. The container closure assembly of claim 5 wherein the puncturing mechanism is generally cylindrical, defines a vertical axis and includes an end that comprises a contact cone having a contact surface, wherein the contact surface forms an angle of between about 40 degrees and 89 about degrees with the vertical axis.

12. The container closure assembly of claim 5 wherein the puncturing mechanism is generally cylindrical, defines a vertical axis and includes an end that comprises a contact cone having a contact surface, wherein the contact surface forms an angle of between about 65 degrees and 75 about degrees with the vertical axis.

13. The container closure assembly of claim 5 wherein the puncturing mechanism contacts over 50% of the surface area of the top surface of the membrane when the membrane is punctured.

14. The container closure assembly of claim 5 wherein the cap includes a bottom surface, wherein a distance is defined between the ring and the bottom surface of the cap before the frangible connection therebetween is broken, wherein the ring includes a bumper extending upwardly therefrom, and wherein the distance between the top of the bumper and the bottom surface of the cap in a vertical direction is less than the distance from the ring to the bottom surface of the cap.

15. A container closure assembly comprising:

a. a base that is adapted to be connected to a container, but which is a separate component before being connected to the container, b. a spout extending upwardly from the base, wherein the spout defines an interior and includes a nozzle, the interior of which is spanned by a membrane, c. a cap removably secured on the spout, wherein the cap includes a ring depending from and frangibly connected thereto, and wherein the cap includes a puncturing mechanism depending downwardly from a top thereof, wherein rotation of the cap in a first direction breaks the frangible connection between the cap and ring and causes the puncturing mechanism to puncture the membrane.

16. The container closure assembly of claim 15 wherein the base has a canoe-like shape and is connected to the interior of a pouch such that the spout extends upwardly from the pouch.

17. The container closure assembly of claim 15 wherein the base comprises a flange that is adhered to a container such that the spout extends outwardly from the container.

18. A container closure assembly comprising:

a. a base that is adapted to be connected to a container, b. a spout extending upwardly from the base, wherein the spout defines an interior and includes a nozzle, the interior of which is spanned by a membrane that includes at least one slit defined therein, and c. a cap removably secured on the spout, wherein the cap includes a ring depending from and frangibly connected thereto, and wherein the cap includes a puncturing mechanism depending downwardly from a top thereof, wherein rotation of the cap in a first direction breaks the frangible connection between the cap and ring and causes the puncturing mechanism to puncture the membrane.

19. The container closure assembly of claim 18 wherein the membrane includes a plurality of intersecting slits defined therein.

20. The container closure assembly of claim 18 wherein the membrane includes a plurality of slits defined therein that meet at a common point.

21. The container closure assembly of claim 20 wherein the plurality of slits are defined by a plurality of wedge shaped flaps.

22. A container comprising:

a. a container portion that contains a liquid therein, b. a spout extending outwardly from the container portion, wherein the spout defines an interior and includes a nozzle, the interior of which is spanned by a sealed membrane, wherein the membrane is adapted to be broken, wherein after the membrane is broken it includes a plurality of flaps that cooperate to define a plurality of slits therein, c. a cap removably secured on the spout, wherein the cap includes a ring depending from and frangibly connected thereto, and wherein the cap includes a puncturing mechanism depending downwardly from a top thereof, wherein the liquid can only be dispensed through the slits by positive or negative pressure placed on the container portion.

23. A container comprising:

a. a container portion, b. a spout extending upwardly from the container portion, wherein the spout defines an interior and includes a nozzle, the interior of which is spanned by a membrane that includes at least one score line defined therein, and c. a cap removably secured on the spout, wherein the cap includes a puncturing mechanism depending downwardly from a top thereof, wherein the cap includes a ring frangibly connected thereto, and wherein a distance is defined between the ring and the cap before the frangible connection therebetween is broken, wherein rotation of the cap in a first direction causes the puncturing mechanism to puncture the membrane, wherein the distance between the ring and the cap is decreased when the cap is rotated in the first direction.

24. The container of claim 23 wherein the membrane includes intersecting score lines that tear when the membrane is punctured, wherein the torn membrane comprises a plurality of flaps.

25. The container closure assembly of claim 5 wherein a distance is defined between the ring and the cap before the frangible connection therebetween is broken, wherein the distance between the ring and the cap is decreased when the cap is rotated in the first direction.

26. The container closure assembly of claim 5 wherein the membrane is punctured and the frangible connection is broken approximately simultaneously.

* * * * *